US009606514B2

(12) United States Patent
Masaki

(10) Patent No.: US 9,606,514 B2
(45) Date of Patent: Mar. 28, 2017

(54) ELECTRONIC TIMEPIECE

(71) Applicant: Seiko Epson Corporation, Tokyo (JP)

(72) Inventor: Takaya Masaki, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/940,601

(22) Filed: Nov. 13, 2015

(65) Prior Publication Data

US 2016/0161921 A1 Jun. 9, 2016

(30) Foreign Application Priority Data

Dec. 5, 2014 (JP) ..... 2014-246578

(51) Int. Cl.
*G04R 20/02* (2013.01)
*G04R 60/12* (2013.01)
*G04G 17/08* (2006.01)

(52) U.S. Cl.
CPC ..... *G04G 17/08* (2013.01); *G04R 60/12* (2013.01); *G04R 20/02* (2013.01)

(58) Field of Classification Search
CPC ..... G04G 17/02; G04G 17/04; G04G 17/08; G04R 20/02; G04R 60/02; G04R 60/06; G04R 60/08; G04R 60/10; G04R 60/12
See application file for complete search history.

(56) References Cited

U.S. PATENT DOCUMENTS

| | | | | |
|---|---|---|---|---|
| 5,331,608 | A * | 7/1994 | Umemoto | G04G 21/04 368/10 |
| 5,798,984 | A * | 8/1998 | Koch | G04G 21/04 343/718 |
| 7,190,638 | B2 * | 3/2007 | Oguchi | G04C 10/02 368/204 |
| 9,128,470 | B2 | 9/2015 | Yanagisawa et al. | |
| 2012/0120772 | A1 * | 5/2012 | Fujisawa | G04C 10/02 368/64 |
| 2012/0170423 | A1 * | 7/2012 | Fujisawa | G04C 10/02 368/10 |
| 2013/0148482 | A1 * | 6/2013 | Nagahama | G04C 10/02 368/205 |
| 2013/0242711 | A1 * | 9/2013 | Fujisawa | G04R 60/06 368/47 |
| 2014/0085154 | A1 * | 3/2014 | Nagahama | G04R 60/10 343/720 |
| 2014/0286135 | A1 * | 9/2014 | Nagahama | G04C 10/02 368/38 |

FOREIGN PATENT DOCUMENTS

| | | |
|---|---|---|
| JP | 2013-181918 A | 9/2013 |
| JP | 2013-181920 A | 9/2013 |

* cited by examiner

*Primary Examiner* — Vit W Miska
(74) *Attorney, Agent, or Firm* — Harness, Dickey & Pierce, P.L.C.

(57) ABSTRACT

An electronic timepiece has a base plate and a base plate bridge ring. The base plate bridge ring secures a ring-shaped antenna, contacts an outside case member, and supports the base plate. The base plate is configured to not contact the outside case member.

8 Claims, 23 Drawing Sheets

10

ELECTRONIC TIMEPIECE

BACKGROUND

1. Technical Field

The present invention relates to an electronic timepiece that has an antenna.

2. Related Art

A GPS timepiece that receives signal information from GPS (Global Positioning System) satellites and displays the precise time requires an antenna to receive the signals. A wristwatch type GPS timepiece (referred to below as an electronic timepiece) must necessarily be small, preferably has the basic round shape of a wristwatch, requires a small antenna, and must prevent damage to the antenna by reliably securing the antenna in the movement.

To satisfy these requirements, JP-A-2013-181918 describes an electronic timepiece that has a ring-shaped antenna, mounts the ring-shaped antenna on a reference surface of the base plate, and also has an urging member that urges the ring-shaped antenna to the reference surface.

To change the size, such as the outside diameter, of the electronic timepiece, or change the diameter of the ring-shaped antenna, of the electronic timepiece described in JP-A-2013-181918, however, both the base plate and the urging member must be redesigned. As a result, changing the size, such as the outside diameter, of the electronic timepiece, or changing the diameter of the ring-shaped antenna, requires redesigning a large number of parts, and may require many steps and much time to completion of the electronic timepiece after the design change.

SUMMARY

The present invention is directed to solving at least part of the foregoing problem, and an objective of the invention is to provide an electronic timepiece that minimizes the number of parts that must be redesigned in order to change the outside diameter of the timepiece case or the size of the antenna.

EXAMPLE 1

An electronic timepiece according to one aspect of the invention has a base plate; and a base plate bridge ring that secures a ring-shaped antenna, contacts an outside case member, and supports the base plate. The base plate does not contact the outside case member.

Thus comprised, the base plate bridge ring that supports the base plate secures the antenna, and the base plate does not contact the outside case member. As a result, when the outside diameter of the electronic timepiece is changed, or the diameter of the antenna is changed, for example, the base plate can be used without modification, and the design change can be accommodated by changing only the design of the base plate bridge ring.

An electronic timepiece with an internal antenna that enables model changes including changing the outside diameter of the timepiece case and changing the size of the antenna while minimizing the number of parts that must be changed to accommodate the design change can be provided.

EXAMPLE 2

The electronic timepiece above, also having a solar panel, and the base plate functioning to guide the solar panel.

Thus comprised, by using a solar panel with common shapes that are guided by the base plate, the same base plate can still be used when the outside diameter of the electronic timepiece or the size of the antenna is changed, and the new timepiece design can be accommodated by changing only the design of the base plate bridge ring. Note that because the solar panel cannot be seen from outside the electronic timepiece, the same size of solar panel can be used before the outside diameter of the timepiece or the antenna is changed and after the design change, and the shape or size of parts other than the shapes that are guided by the base plate can be changed.

EXAMPLE 3

The electronic timepiece above, also having a dial, and the base plate having a dial guide post that guides the dial.

Thus comprised, when the outside diameter of the electronic timepiece or the size of the antenna is changed, by using a dial with the same shapes that are guided by the base plate, the same base plate can be used when the outside diameter of the electronic timepiece or the size of the antenna changes, and the design change can be accommodated by changing only the design of the base plate bridge ring. Furthermore, because the base plate does not change, the same dial can also be used.

EXAMPLE 4

The electronic timepiece above, wherein: the dial has a recess in which the dial guide post fits in an area overlapping the dial guide post of the base plate in plan view.

Thus comprised, the same base plate can be used to accommodate design changes that increase the outside diameter of the electronic timepiece and the parting diameter.

The dial can also be guided to the base plate by fitting the dial guide posts of the base plate into the recesses in the dial.

EXAMPLE 5

The electronic timepiece above, wherein: a marker is disposed to the dial in an area overlapping the dial guide post of the base plate in plan view.

Thus comprised, when the outside diameter of the electronic timepiece and the parting diameter are increased, the dial guide posts exposed at the surface of the dial can be hidden from view by the marker. A common base plate can therefore be used when changing the design of the timepiece.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of the present invention is described below with reference to the accompanying figures. Note that the scale of various layers and parts of the electronic timepiece differ from the actual scale shown in the figures in order to illustrate the layers and parts in a size enabling better recognition and understanding. The following embodiments include various technically desirable limitations while describing preferred embodiments of the invention, but the scope of the invention is not limited to the following unless such limitation is expressly stated.

A: Summary of an Electronic Timepiece

Figure 1:
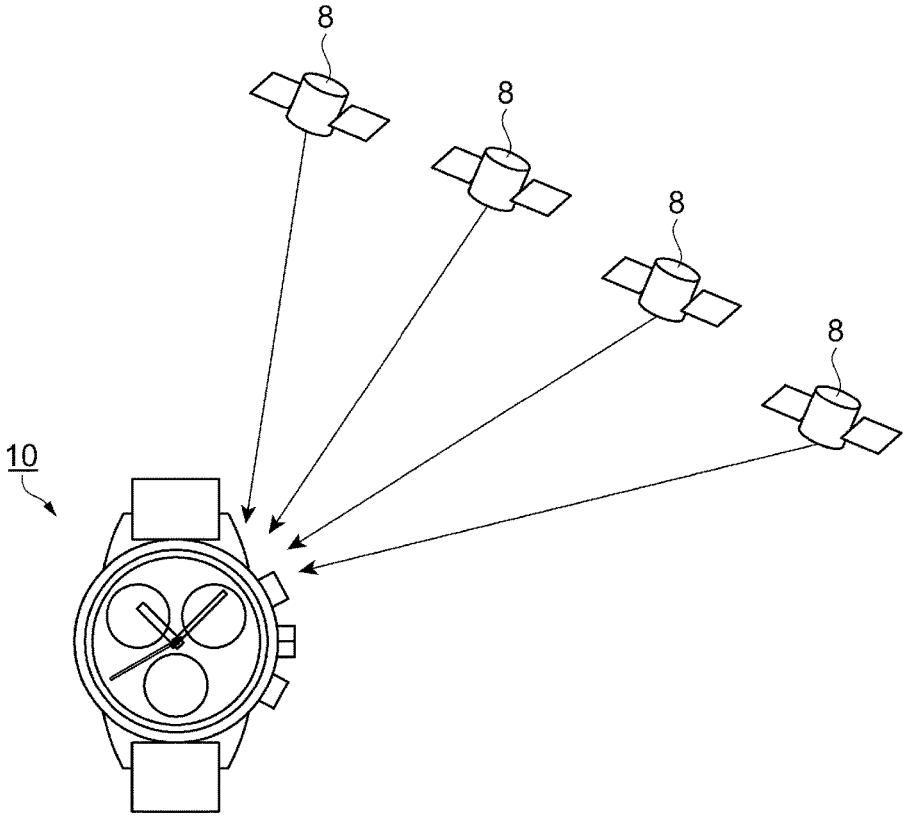
FIG. 1 illustrates the application of a GPS system including an electronic timepiece according to the invention.

Preferred embodiments of the invention are described below with reference to FIG. 1 to FIGS. 26A-26C. FIG. 1 illustrates an application of the Global Positioning System (GPS) using an electronic timepiece according to the invention. The basic configuration of the GPS whereby an electronic timepiece operating as a GPS receiver receives RF signals from the GPS satellites to obtain location information and time information for the current location is described first.

The electronic timepiece 10 in this embodiment of the invention is a wristwatch that receives RF signals (satellite signals) from GPS satellites 8, and adjusts the internal time and displays the current time on the opposite side of the wristwatch (the face) as the side of the wristwatch worn in contact with the wrist (the back).

The GPS satellites 8 are navigational satellites that orbit the Earth on specific orbits in space, and broadcast a navigation message superimposed on a 1.57542 GHz carrier wave (L1 wave). For brevity below, the 1.57542 GHz carrier wave to which the navigation message is superimposed is referred to as the satellite signal. The satellite signals are right-hand circularly polarized waves.

There are presently 31 GPS satellites 8 in orbit (only 4 are shown in FIG. 1), and to identify which of the GPS satellites 8 transmitted the received satellite signal, a unique 1023 chip (1 ms) pattern called a C/A code (Coarse/Acquisition Code) is superimposed by each GPS satellite 8. Each chip in the C/A code denotes +1 or −1, and the C/A code appears as a pseudorandom pattern. Therefore, by determining the correlation between the satellite signal and the pattern of each C/A code, the C/A code superimposed on a particular satellite signal can be detected.

Each GPS satellite 8 carries an atomic clock, and precise GPS time information that is kept by the atomic clock is embedded in each satellite signal. The electronic timepiece 10 receives a satellite signal transmitted from one GPS satellite 8, and sets the internal time of the electronic timepiece 10 to the time (time information) obtained using the GPS time information contained in the received satellite signal.

Orbit information identifying the location of the GPS satellite 8 on its orbit is also contained in the satellite signal. The electronic timepiece 10 performs a positioning calculation using the GPS time information and orbit information. This positioning calculation assumes there is a certain amount of error in the internal time of the electronic timepiece 10.

More specifically, in addition to the x, y, z parameters for acquiring the location of the electronic timepiece 10 in three dimensions, the time difference is also an unknown variable. The electronic timepiece 10 therefore generally receives satellite signals transmitted from four or more GPS satellites 8, and runs the positioning calculation using the GPS time information and orbit information contained in the received satellite signals to determine the location information of the current location.

Figure 2:
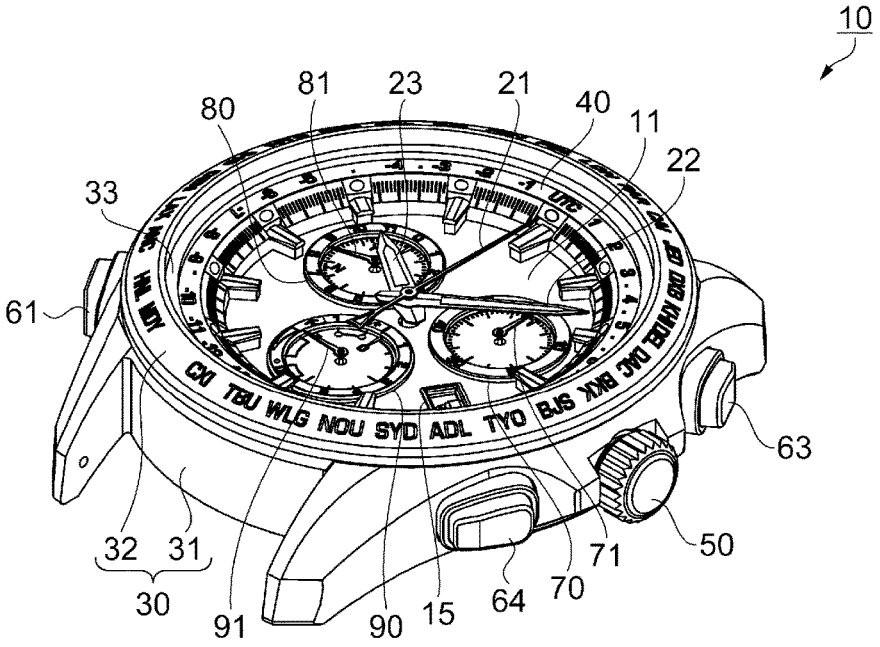
FIG. 2 is an oblique view showing an overview of an electronic timepiece.

The basic configuration of the electronic timepiece 10 is described next. FIG. 2 is an oblique view showing the appearance of the electronic timepiece 10, FIGS. 3A-3F show six views of the appearance of the electronic timepiece 10, and FIG. 4 is a partial section view showing the configuration of the electronic timepiece 10.

Figures 3A, 3B, 3C, 3D, 3E, 3F:
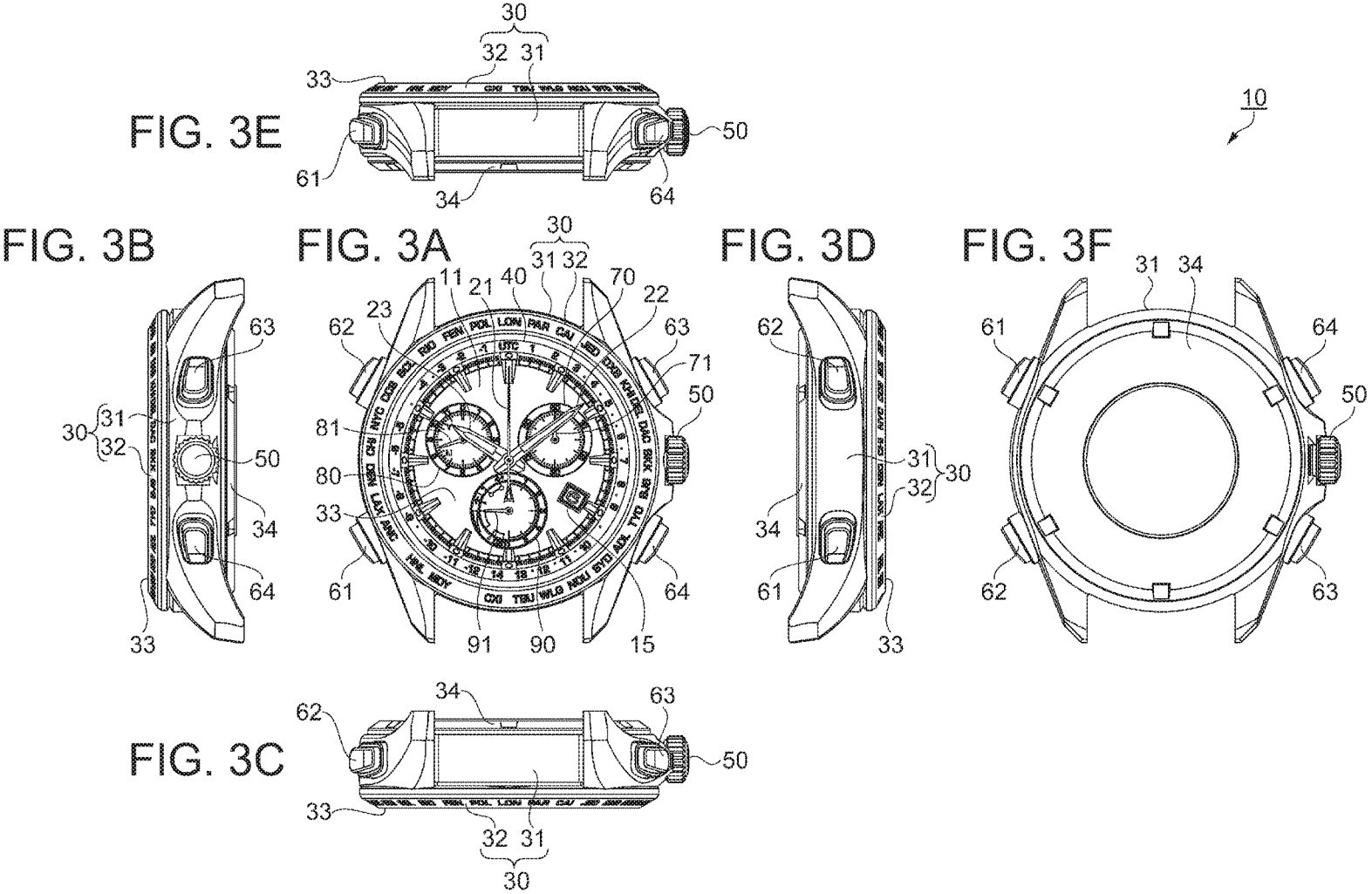
FIGS. 3A-3F show six different views of the electronic timepiece.
Figure 4:
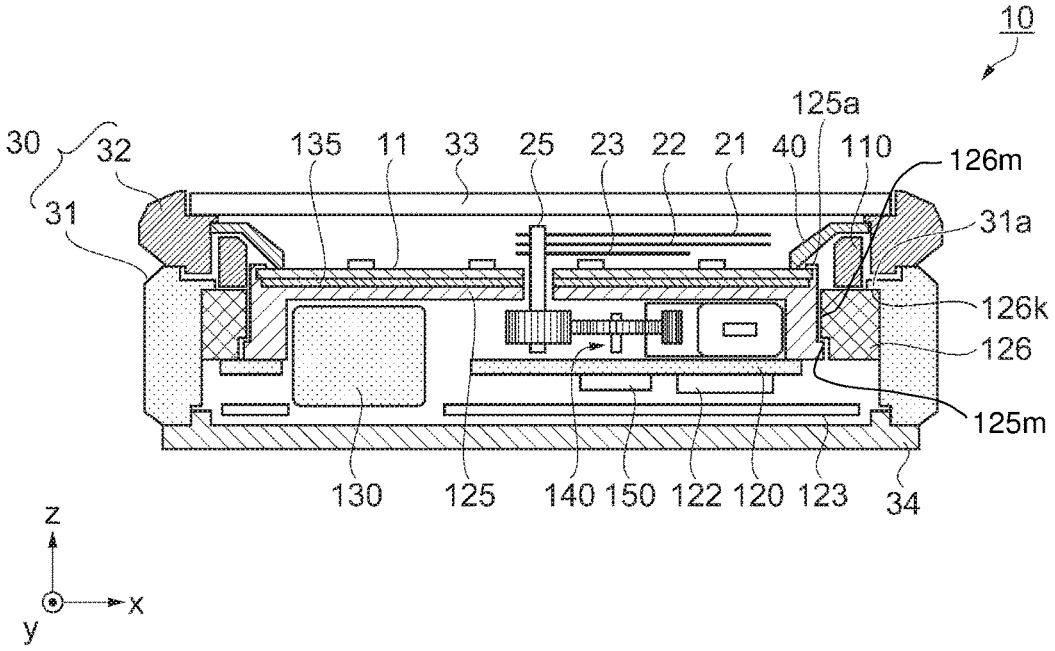
FIG. 4 is a section view showing part of the electronic timepiece.

Note that FIG. 3A is a plan view of the electronic timepiece from the face side, and FIG. 3B is a side view looking from the 3:00 position to the 9:00 position. FIG. 3C is a side view looking from the 12:00 position to the 6:00 position. FIG. 3D is a side view looking from the 9:00 position to the 3:00 position. FIG. 3E is a side view looking from the 6:00 position to the 12:00 position. FIG. 3F is a plan view of the back of the electronic timepiece 10.

The electronic timepiece 10 according to this embodiment has a world time function and a chronograph function.

As shown in FIG. 2 and FIGS. 3A-3F, the electronic timepiece 10 has an outside case 30, a crystal 33, and a back cover 34.

The outside case 30 includes a ceramic bezel 32 fit to a tubular case member 31 made of metal. A disc-shaped dial 11 is disposed as the time display part through a plastic annular dial ring 40 on the inside circumference side of the bezel 32.

Hands 21, 22, 23 are disposed above the dial 11. Around the center of the dial 11 are further disposed a round first subdial 70 and hand 71 at 2:00; a round second subdial 80 and hand 81 at 10:00; a round third subdial 90 and hand 91 at 6:00; and a rectangular calendar window 15 at 4:00. The dial 11, hands 21, 22, 23, first subdial 70, second subdial 80, third subdial 90, and calendar window 15 can be seen through the crystal 33.

A button A 61 is disposed in the side of the outside case 30 at 8:00 from the center of the dial 11; a button B 62 is disposed at 10:00; a button C 63 is disposed at 2:00; a button D 64 is disposed at 4:00; and a crown 50 is disposed at 3:00. When the button A 61, button B 62, button C 63, button D 64, and crown 50 are operated, operating signals corresponding to the specific operation are output.

As shown in FIG. 4, of the two main openings in the metal outside case 30, the opening on the face side of the electronic timepiece 10 is covered by the crystal 33 through the intervening ceramic bezel 32, and the opening on the back side is covered by the metal back cover 34.

Disposed inside the outside case 30 are the dial ring 40 attached to the inside circumference of the ceramic bezel 32; an optically transparent dial 11; a center arbor 25 that passes through the dial 11; the hands 21, 22, 23 that rotate on the center arbor 25; and a drive mechanism 140 that drives the hands 21, 22, 23.

The center arbor 25 is in the center of the outside case 30 in plan view, and is disposed on the center axis between the face and back of the timepiece.

The dial ring 40 has a flat portion of which the outside edge contacts the inside circumference surface of the bezel 32 and one surface is parallel to the crystal 33; and a beveled portion that slopes toward the dial 11 so that the inside edge contacts the dial 11. The dial ring 40 is ring-shaped when seen in plan view, and conically shaped when seen in section view. A donut-shaped storage space is formed by the flat portion and the beveled portion of the dial ring 40, and the inside circumference surface of the bezel 32. A ring antenna 110 is housed in this storage space. The inside diameter of the dial ring 40, that is, the visible diameter of the dial 11, is referred to below as the parting diameter.

The antenna 110 has a ring-shaped dielectric base on which a metal antenna pattern is formed by a plating or silver paste printing process. The antenna 110 is disposed around the perimeter of the dial 11 and the inside circumference side of the bezel 32, is covered by the plastic dial ring 40 and crystal 33, and can therefore assure good reception. The dielectric in this embodiment is molded from a titanium oxide or other high frequency dielectric material mixed with resin, and enables rendering a small antenna by using the wavelength-shortening effect of the dielectric.

The dial 11 is a round disc for indicating the time inside the outside case 30, is made from plastic or other optically transmissive material, and is disposed inside the dial ring 40 with the hands 21, 22, 23 between the dial 11 and the crystal 33.

A photovoltaic solar panel 135 (solar battery) is disposed between the dial 11 and the base plate 125. The solar panel 135 is a round panel having a plurality of solar cells (photovoltaic elements) that convert light energy to electrical energy connected in series. The solar panel 135 also has a sunlight detection function.

The solar panel 135 is positioned by first guide posts 125*a* described further below that are formed on the base plate 125.

Holes through which the center arbor 25, arbors (not shown in the figure) for the hand 71 of the first subdial 70, the hand 81 of the second subdial 80, and the hand 91 of the third subdial 90 pass, and the aperture of the calendar window 15, are formed in the dial 11, the solar panel 135, and the base plate 125.

The drive mechanism 140 is attached to the base plate 125, and is covered on the back side by a circuit board 120. The drive mechanism 140 has a stepper motor and a wheel train of wheels, and drives the hands 21, 22, 23 by the stepper motor turning the center arbor 25 through the wheel train. The hand 71 of the first subdial 70, the hand 81 of the second subdial 80, and the hand 91 of the third subdial 90 shown in FIG. 2 and FIGS. 3A-3F have similar drive mechanisms (not shown in the figure) that drive the hands 71, 81, 91.

The circuit board 120 has a receiver unit (GPS module) 122, control unit 150, and a lithium ion or other storage battery 130. The storage battery 130 is charged by power produced by the solar panel 135. The circuit board 120 and antenna 110 are connected through an antenna connection pin not shown. A circuit cover 123 is disposed below the circuit board 120.

The antenna 110 is powered through a power supply node, and the antenna connection pin disposed on the back side of the antenna 110 is connected to the power supply node. The antenna connection pin is a metal pin-shaped connector that is disposed to the circuit board 120 and passes through a through-hole formed in the base plate bridge ring 126 into the storage space. The circuit board 120 and the antenna 110 inside the storage space are thus connected by the antenna connection pin.

The base plate 125 is plastic, and has mounts for the drive mechanism 140 and storage battery 130 inside. Guide posts such as the first guide posts 125*a* are disposed to the base plate 125 for positioning the dial 11 and solar panel 135, and the guide posts protrude toward the face side of the timepiece.

The base plate bridge ring 126 is also plastic, and is the support member that supports the base plate 125. The base plate bridge ring 126 is disposed to approximately the same height as the base plate between the outside circumference of the base plate 125 and the inside circumference of the case member 31 of the outside case 30. The base plate bridge ring 126 supports the base plate 125 in the outside case 30 by means of protrusions 126*m* formed on the inside circumference of the base plate bridge ring 126 contacting the outside circumference 125*m* of the base plate 125, and protrusions 126*k* on the outside circumference of the base plate bridge ring 126 contacting the inside circumference 31*a* of the case member 31 of the outside case 30. The base plate 125 therefore does not directly contact the outside case 30. Panel hooks 126*a* (not shown in the figure) for securing the dial 11 and solar panel 135 positioned by the base plate 125 are disposed to the base plate bridge ring 126 as described further below.

Note that the base plate bridge ring 126 must only support at least the base plate 125 in the outside case 30, and is not limited to the configuration described above.

B: Electrical Configuration of the Electronic Timepiece

The electrical configuration of the electronic timepiece 10 is described next.

Figure 5:
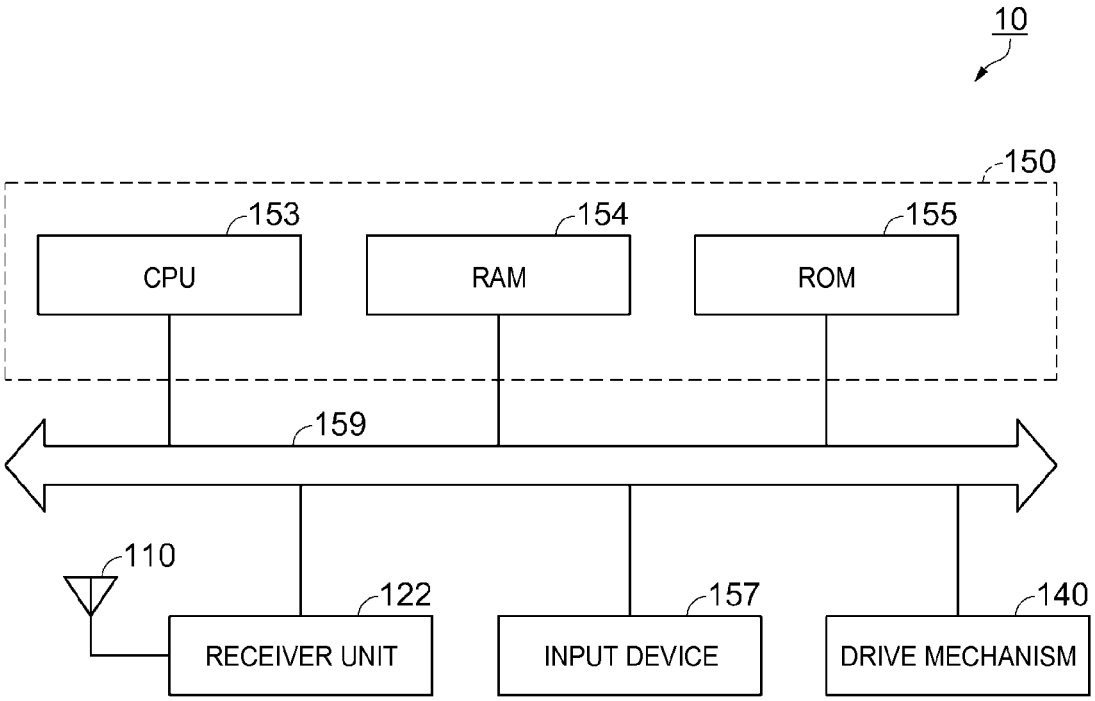
FIG. 5 is a block diagram illustrating the electrical control system of the electronic timepiece.

FIG. 5 is a block diagram of the electrical control system of the electronic timepiece. As shown in FIG. 5, the electronic timepiece 10 has a control unit 150 with a basic configuration including a CPU (central processing unit) 153, RAM (random access memory) 154, and ROM (read-only memory) 155; and peripheral devices including a receiver unit 122 (GPS module), an input device 157, and the drive mechanism 140. These devices exchange data through a data bus 159.

The input device 157 includes the crown 50, button A 61, button B 62, button C 63, and button D 64 shown in FIGS. 3A-3F. Note that the electronic timepiece 10 also has a rechargeable storage battery 130 (FIG. 4) as the power supply.

The receiver unit 122 includes the antenna 110, processes satellite signals received through the antenna 110, and acquires GPS time information and location information. The antenna 110 receives the radio waves of satellite signals that are transmitted from a plurality of GPS satellites 8 (see FIG. 1) orbiting the Earth on specific orbits in space and pass through the crystal 33 and dial ring 40 shown in FIG. 4.

As shown in the figure and similarly to a common GPS receiver, the receiver unit 122 includes an RF (radio frequency) unit that receives and converts satellite signals transmitted from the GPS satellites 8 (FIG. 1) to digital signals; a baseband unit that executes a reception signal correlation process and demodulates the navigation message; and a data acquisition unit that acquires and outputs the GPS time information and location information (positioning information) from the navigation message (satellite signals) demodulated by the baseband unit. The receiver unit 122 thus functions as a receiver that receives satellite signals transmitted from the GPS satellites 8, and outputs GPS time information and location information based on the result of reception.

The RF unit includes a bandpass filter, PLL circuit, IF filter, VCO (voltage controlled oscillator), ADC (A/D converter), mixer, LNA (low noise amplifier), and IF amplifier.

The satellite signal extracted by the bandpass filter is amplified by the LNA, mixed by the mixer with the signal from the VCO, and down-converted to an IF (intermediate frequency) signal. The IF signal mixed by the mixer then passes through the IF amplifier and IF filter, and is converted by the A/D converter to a digital signal.

The baseband unit has a local code generator and a correlation unit.

The local code generator generates local codes that are the same as the C/A codes used by the GPS satellites 8 for signal transmission.

The correlation unit calculates the correlation between the local codes and the reception signal output from the RF unit. If the correlation calculated by the correlation unit equals or exceeds a specific threshold, the C/A code used in the received satellite signal and the local code that was generated match, and the satellite signal can be locked (synchronized). The navigation message can therefore be demodulated by the correlation process using the received satellite signal and a local code.

The data acquisition unit acquires the GPS time information and location information from the navigation message demodulated by the baseband unit. The navigation message contains preamble data, the TOW (Time of Week, also called the Z count) of the HOW word, and subframe data. There are five subframes, subframe 1 to subframe 5, and each subframe contains satellite correction data including a week number value and satellite health data, ephemeris data (detailed orbit information for a particular GPS satellite 8), and almanac data (basic orbit information for all GPS satellites 8). The data acquisition unit can therefore acquire the GPS time information and navigation information by extracting specific data from the received navigation message.

RAM 154 and ROM 155 are the storage unit of the electronic timepiece 10.

A program run by the CPU 153 and time zone information are stored in ROM 155. The time zone information is data for managing location information (latitude and longitude) about geographical areas (time zones) using a common standard time, and the difference to UTC.

By running a program stored in ROM 155 using RAM 154 as working memory, the CPU 153 performs various calculation, control, and timekeeping operations. This timekeeping is done by counting the number of pulses in a reference signal from an oscillation circuit not shown, for example.

The CPU 153 corrects the internal clock based on the time information calculated from the GPS time and time correction parameter, the current location (longitude and latitude) calculated from the GPS time and orbit information, and the time zone information stored in ROM 155 (storage unit). The CPU 153 also controls driving the drive mechanism 140 to display the internal time. As a result, the internal time is displayed on the electronic timepiece 10 by the hands 21, 22, 23 (see FIGS. 3A-3F).

C: Securing the Solar Panel

Figure 6:
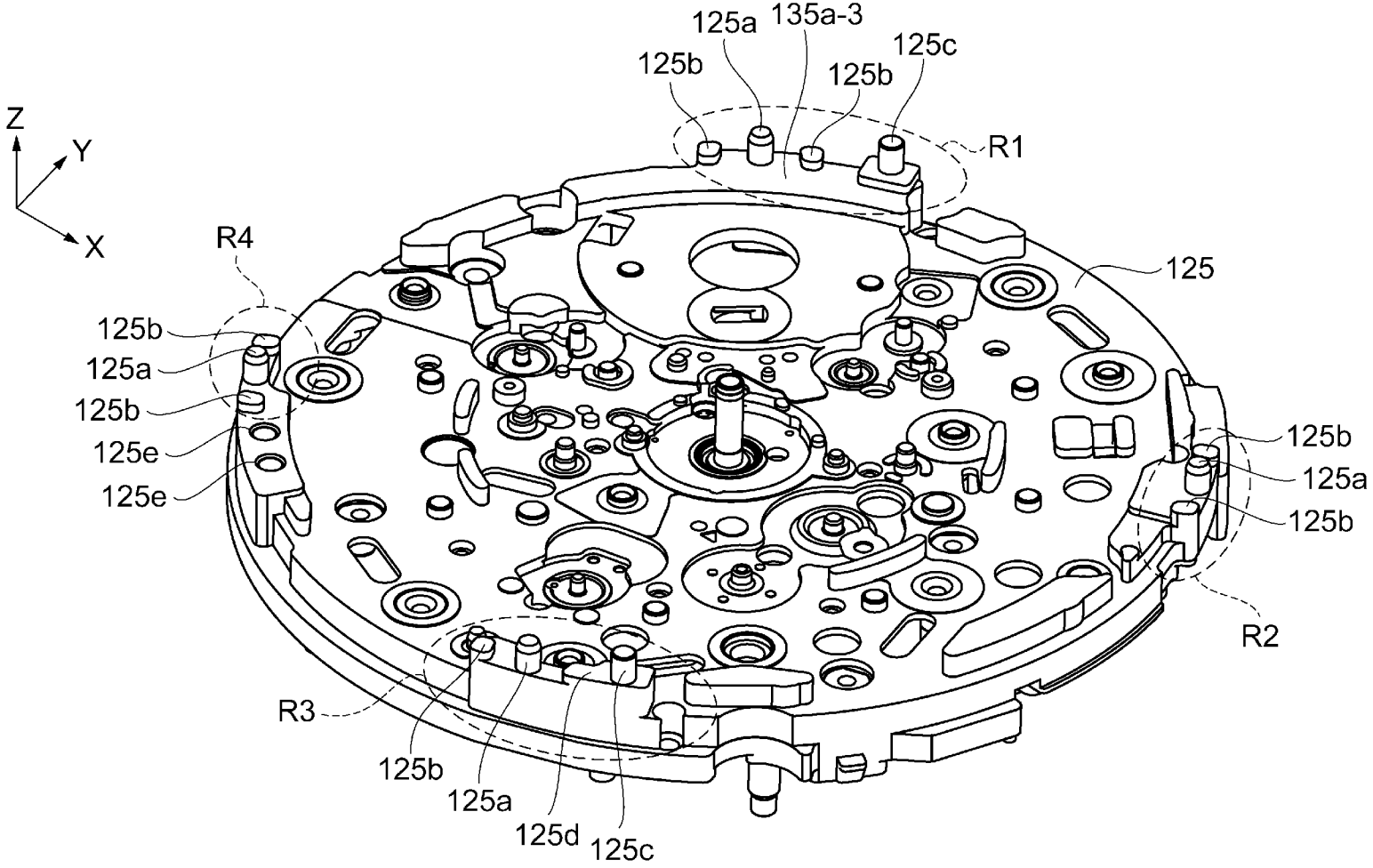
FIG. 6 is an oblique view of the base plate.
Figure 7:
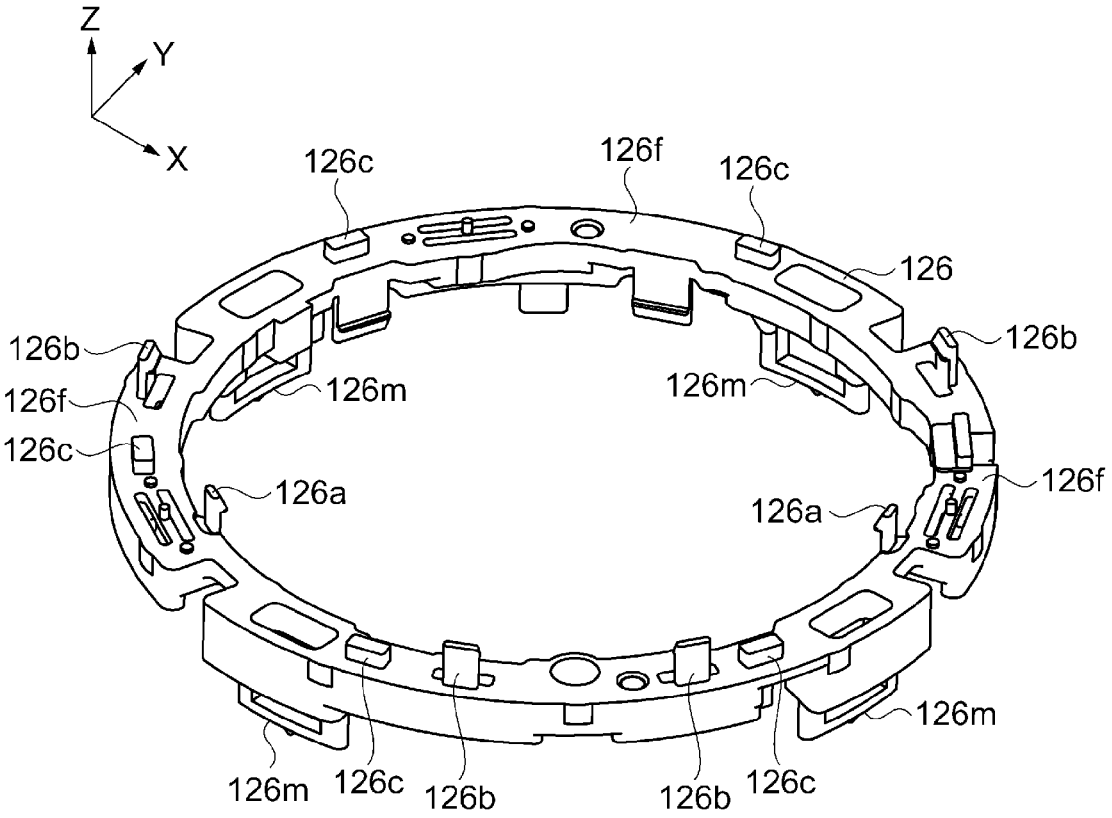
FIG. 7 is an oblique view of the base plate bridge ring.
Figure 8:
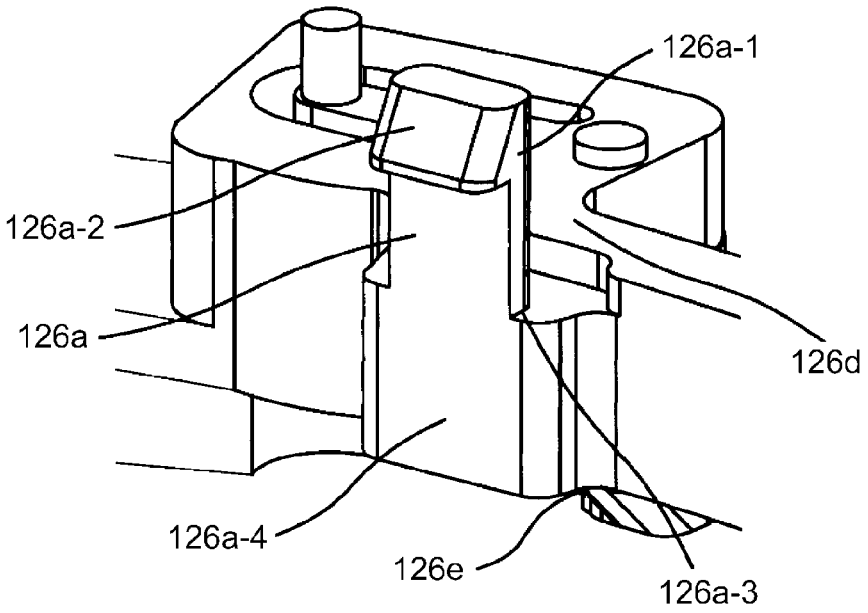
FIG. 8 is an enlarged oblique view of the area around a panel hook of the base plate bridge ring.
Figure 9:
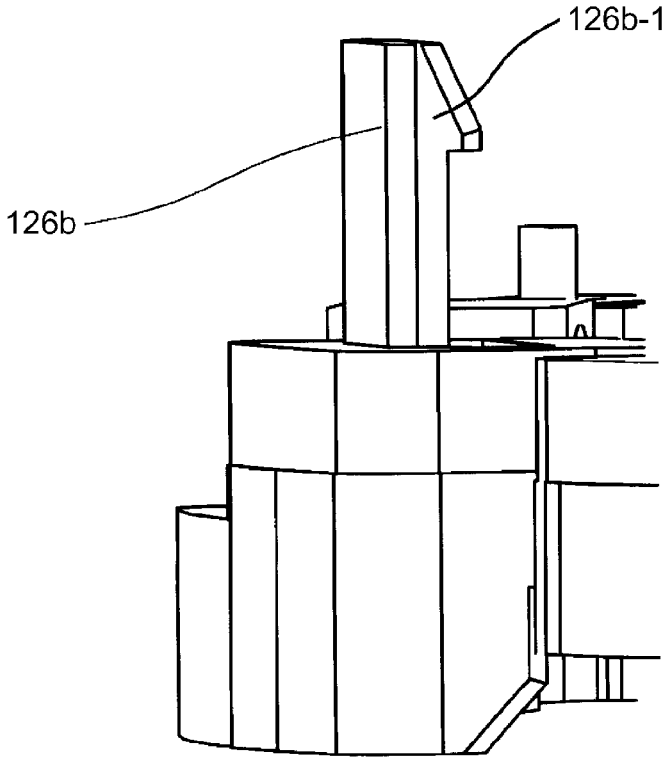
FIG. 9 is an enlarged oblique view of the area around an antenna hook of the base plate bridge ring.

The configuration that secures (holds) the solar panel 135 in the electronic timepiece 10 is described next. FIG. 6 is an oblique view of the base plate 125, and FIG. 7 is an oblique view of the base plate bridge ring 126. FIG. 8 is an enlarged oblique view of the area around a panel hook of the base plate bridge ring 126, and FIG. 9 is an enlarged oblique view of the area around an antenna hook of the base plate bridge ring 126.

As shown in FIG. 6, sets of first guide posts 125*a* and second guide posts 125*b* for positioning and guiding the solar panel 135 and dial 11 are formed at four places on the base plate 125, a first position R1, second position R2, third position R3, and fourth position R4.

There are two second guide posts 125*b* at each of the first position R1, second position R2, and fourth position R4. The second guide posts 125*b* are disposed on opposite sides of the first guide post 125*a* at a specific distance from the first guide post 125*a*.

At the third position R3, there is only one second guide post 125*b* disposed with a specific gap to the first guide post 125*a* on one circumferential side of the first guide post 125*a*. A flange 125*d* where a positioning pin 125*c* for the dial ring 40 is disposed is also formed along the circumference of the base plate 125 at the third position R3. The end of the flange 125*d* is disposed with a specific gap in the circumferential direction to the first guide post 125*a* on the opposite side of the first guide post 125*a* as the second guide post 125*b* with the first guide post 125*a* therebetween. The end of the flange 125*d* therefore serves the same function as the second guide post 125*b*.

The positioning pins 125*c* disposed to the first position R1 and third position R3 fit into matching holes in the dial ring 40 and secure the dial ring 40.

Through-holes 125*e* for holding conductive springs that electrically connect the circuit board 120 and solar panel 135 are also provided.

As shown in FIG. 7, the base plate bridge ring 126 that functions as the support member of the base plate 125 has panel hooks 126*a* for securing the solar panel 135, antenna hooks 126*b* for securing the antenna 110, and antenna posts 126*c* for securing the antenna 110.

The side of the base plate bridge ring 126 on the same side as the crystal 33 (the side near the solar panel 135) when the base plate bridge ring 126 is installed in the electronic timepiece 10 is referred to as the top, and the side on the same side as the back cover 34 (the side far from the solar panel 135) is referred to below as the bottom.

As shown in FIG. 8, the panel hooks 126*a* are not disposed directly on the top of the base plate bridge ring 126. A shoulder is formed below the top of the base plate bridge ring 126, and the panel hooks 126*a* are formed rising continuously from this shoulder to above the top. The panel hooks 126*a* can therefore be made longer than when formed directly on the top, and the elasticity required to install the solar panel 135 can be increased. A slope 126*a*-2 is formed on the distal end 126*a*-1 of each panel hook 126*a*, thus facilitating installing the solar panel 135 as described further below.

As shown in FIG. 9, the antenna hooks 126*b* are disposed to the top of the base plate bridge ring 126, and secure and position the antenna 110 vertically by the distal ends 126*b*-1 of the antenna hooks 126*b* engaging matching flanges disposed on the outside of the antenna 110 as described further below.

Figure 10:
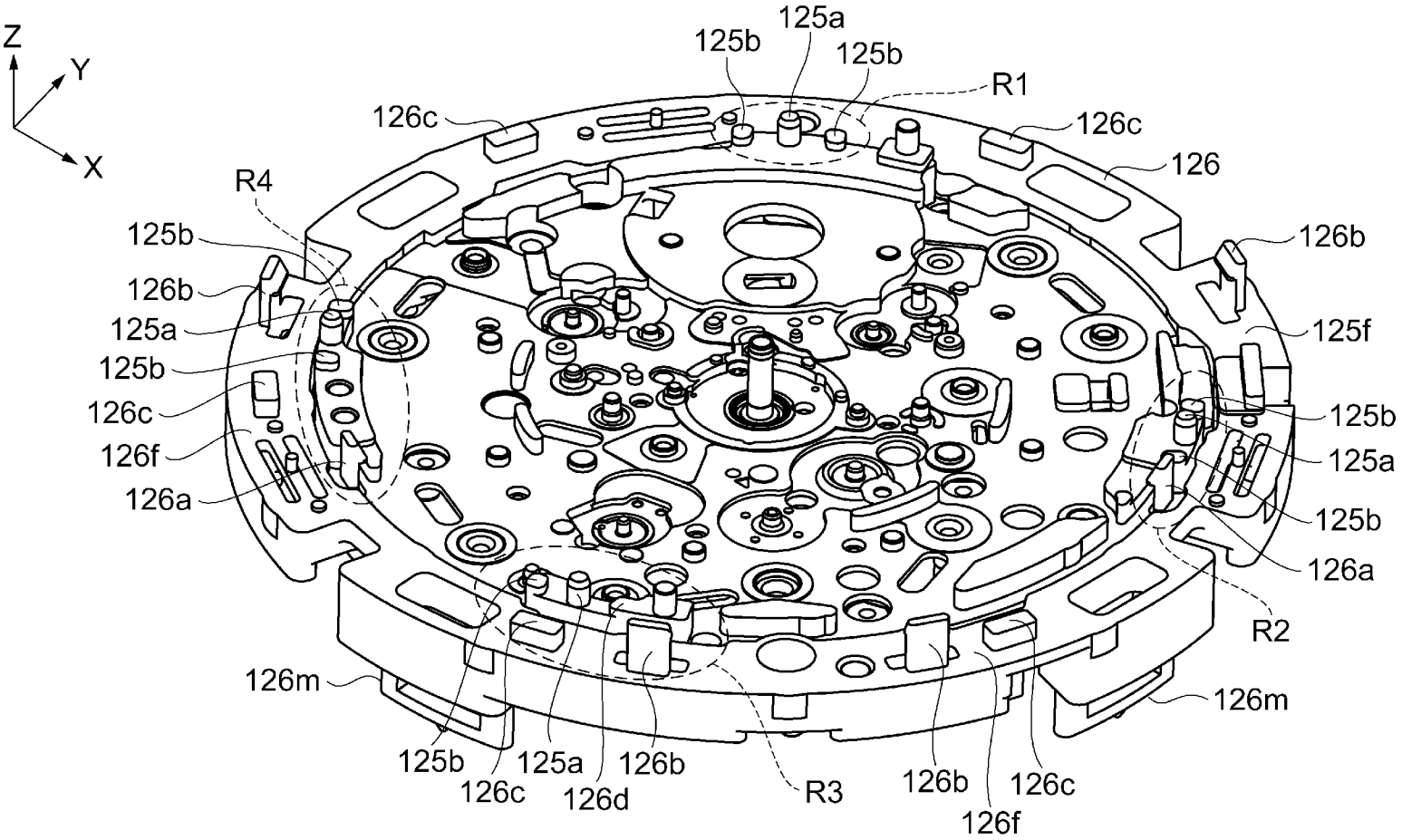
FIG. 10 is an oblique view showing the base plate bridge ring and base plate when fit together.

FIG. 10 is an oblique view showing the base plate bridge ring 126 and the base plate 125 fit together. As shown in FIG. 10, by fitting the base plate bridge ring 126 to the base plate 125, the panel hook 126*a* of the base plate bridge ring 126 are disposed beside the first guide posts 125*a* and second guide posts 125*b* in the circumferential direction of the base plate 125 at the second position R2 and fourth position R4.

At the second position R2 and fourth position R4, the first guide post 125*a* functions as a provisional guide for the solar panel 135, and the panel hooks 126*a* of the base plate bridge ring 126 function as fasteners for the solar panel 135. At the first position R1 and third position R3, the first guide post 125*a* functions as a guide for the solar panel 135.

Figure 11:
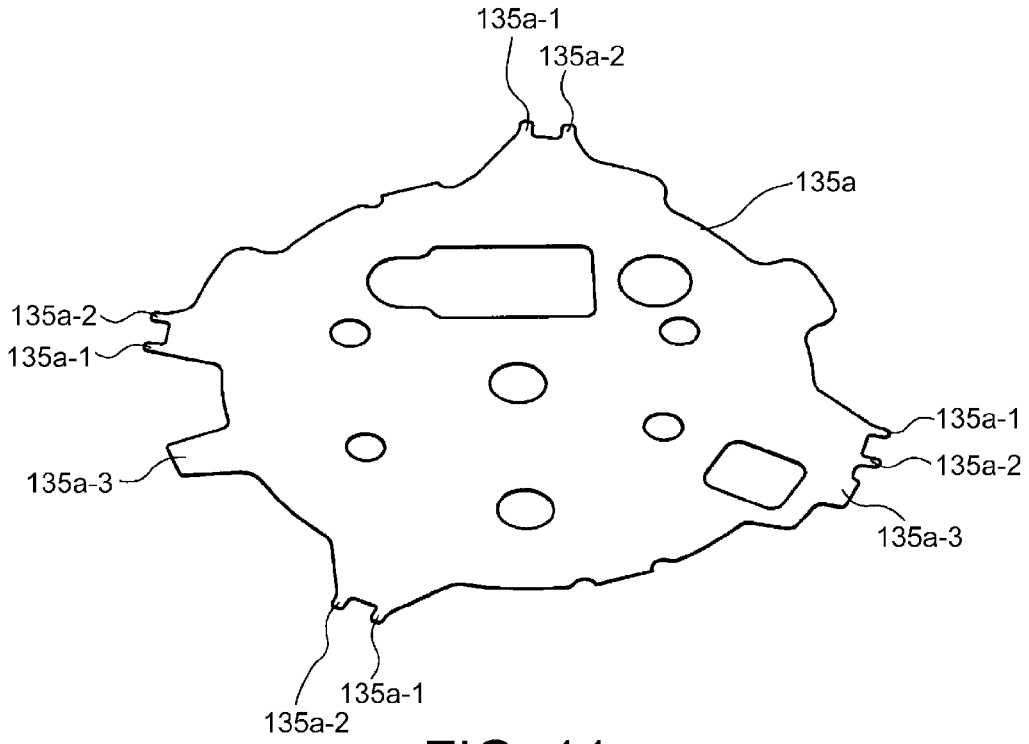
FIG. 11 is an oblique view of the guide plate.

The configuration of the solar panel 135 in this embodiment of the invention is described next with reference to FIG. 11 to FIG. 13. FIG. 11 is an oblique view of the guide plate 135*a*, FIG. 12 is an oblique view of the solar cell film 135*b*, and FIG. 13 is an oblique view of the solar panel 135.

The guide plate 135*a* may be metal or plastic, and as shown in FIG. 11 has sets of first guide tabs 135*a*-1 and second guide tabs 135*a*-2 at four locations. The guide plate 135*a* also has two fastening tabs 135*a*-3 that are used to engage the panel hooks 126*a* of the base plate bridge ring 126.

Figure 12:
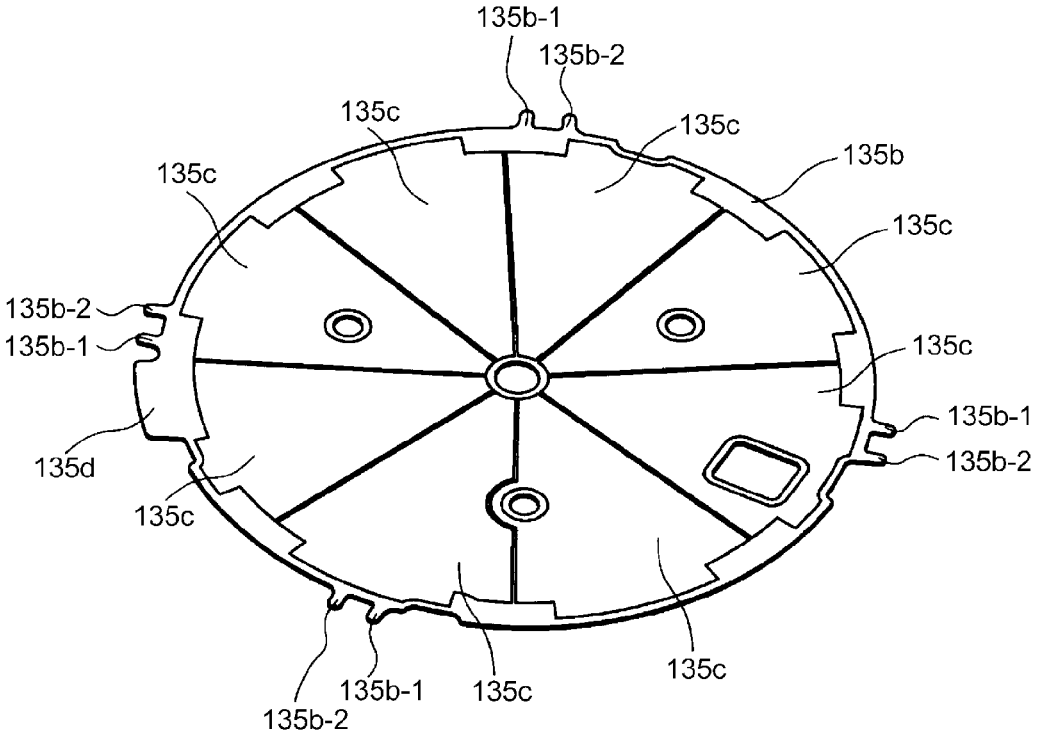
FIG. 12 is an oblique view of the solar cell film.

As shown in FIG. 12, the solar cell film 135*b* is a round film with eight solar cells 135*c*, and has four sets of first tabs 135*b*-1 and second tabs 135*b*-2 corresponding to the first guide tabs 135*a*-1 and second guide tabs 135*a*-2 of the guide plate 135*a*. The solar cell film 135*b* also has one conductive member 135*d* (shown on the left side in FIG. 12).

Figure 13:
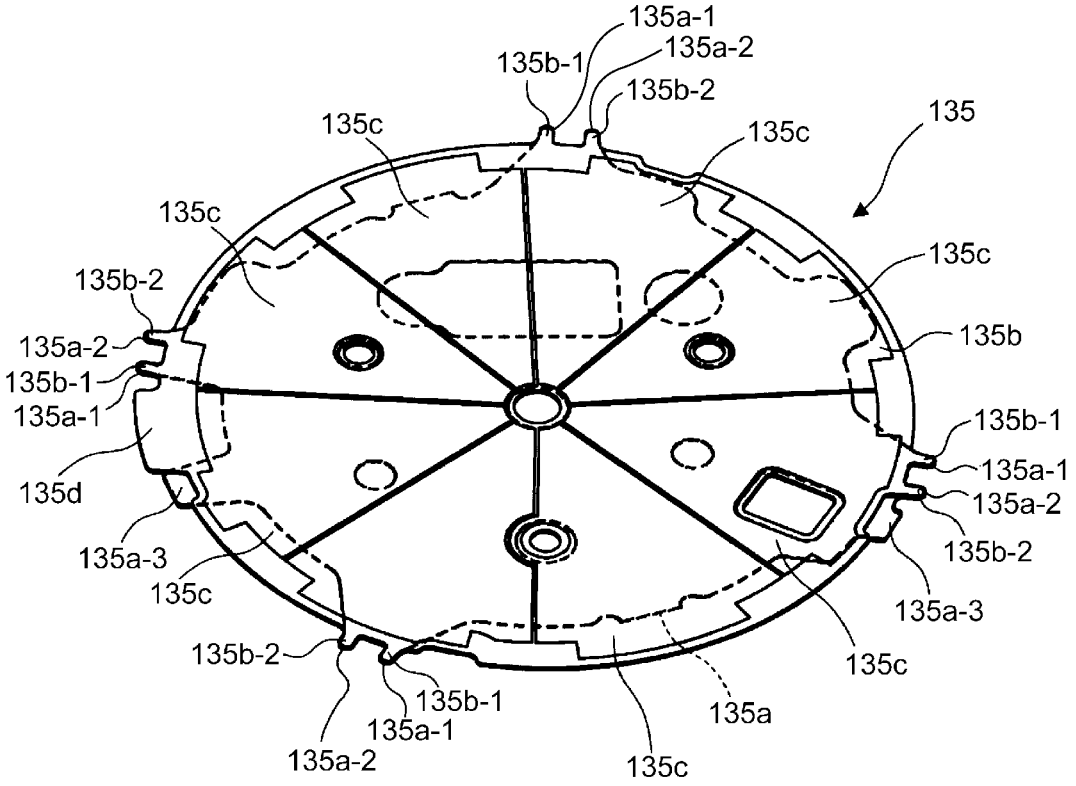
FIG. 13 is an oblique view of the solar panel with the guide plate affixed to the solar cell film.

As shown in FIG. 13, the solar panel 135 comprises the guide plate 135*a* affixed to the solar cell film 135*b*. The guide plate 135*a* is indicated by the dotted line in FIG. 13. Because the first tabs 135*b*-1 and second tabs 135*b*-2 of the solar cell film 135*b* are disposed to position corresponding to the first guide tabs 135*a*-1 and second guide tabs 135*a*-2 of the guide plate 135*a*, they overlap each other when the guide plate 135*a* is affixed to the solar cell film 135*b*. The first tabs 135*b*-1 and second tabs 135*b*-2 of the solar cell film 135*b* are used as guides when putting the guide plate 135*a* and solar cell film 135*b* together. However, the places that actually contribute to guiding alignment of the solar panel 135 are not the first tabs 135*b*-1 and second tabs 135*b*-2, but the first guide tabs 135*a*-1 and second guide tabs 135*a*-2. As a result, in the following description of guiding the solar panel 135, mention of the first tabs 135*b*-1 and second tabs 135*b*-2 is omitted and reference is made to the first guide tabs 135*a*-1 and second guide tabs 135*a*-2 of the solar panel 135, or simply the first guide tabs 135*a*-1 and second guide tabs 135*a*-2.

Note that if the solar cell film 135*b* can be accurately positioned to the guide plate 135*a*, the first tabs 135*b*-1 and second tabs 135*b*-2 of the solar cell film 135*b* may be omitted.

When looking at the solar panel 135 from the top side, the fastening tabs 135*a*-3 are exposed and not covered by the solar cell film 135*b*. The first guide tabs 135*a*-1 and second guide tabs 135*a*-2 are disposed beside the fastening tabs 135*a*-3 near the 3:00 position shown on the right in FIG. 13. Near the 9:00 position shown on the left in FIG. 13, the conductive member 135*d* is disposed between the fastening tabs 135*a*-3 and the first guide tabs 135*a*-1 and second guide tabs 135*a*-2. The first guide tabs 135*b*-1 and second guide tabs 135*b*-2 are disposed near the 12:00 position shown at the top in FIG. 13 and near the 6:00 position shown at the bottom in FIG. 13.

Figure 14:
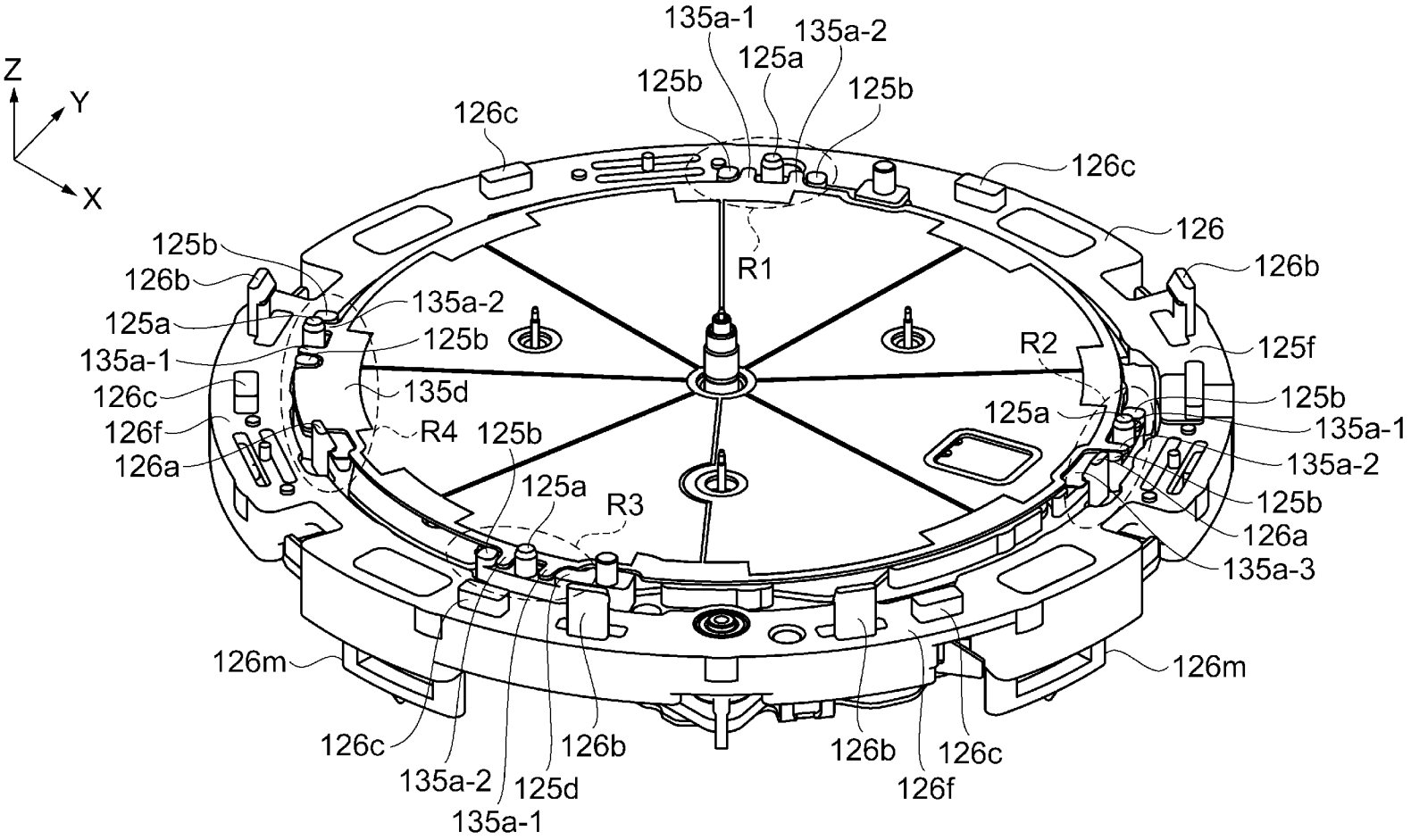
FIG. 14 is an oblique view showing the solar panel secured by hooks of the base plate bridge ring.
Figure 15:
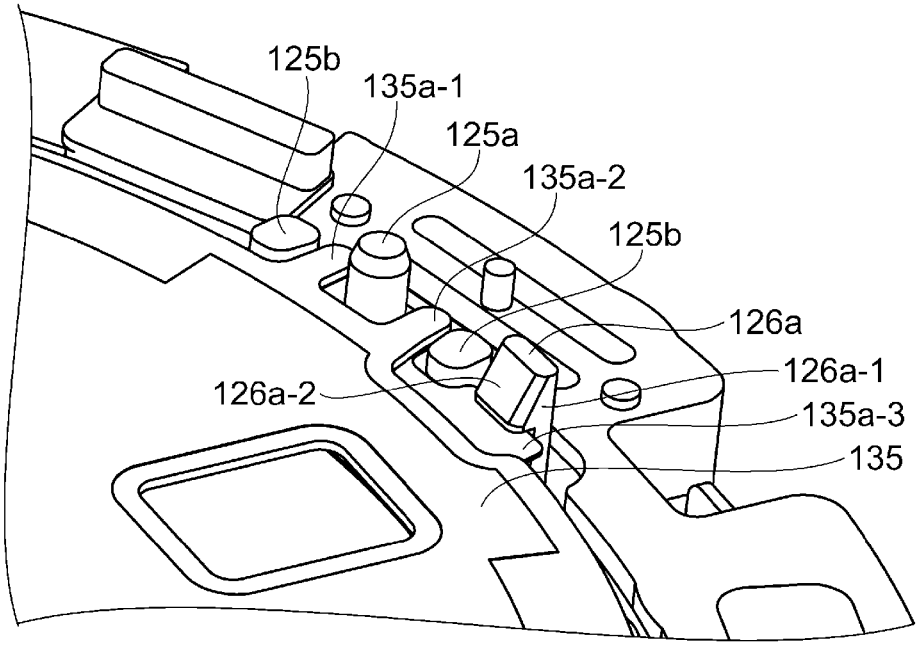
FIG. 15 is an enlarged oblique view showing the area around where the hooks of the base plate bridge ring engage the solar panel.

Positioning the solar panel 135 is described next with reference to FIG. 14 to FIG. 16. FIG. 14 is an oblique view showing the solar panel 135 attached to the base plate bridge ring 126, which is attached to the base plate 125 shown in FIG. 10. FIG. 15 is an enlarged oblique view of the area around the provisional guide and fastener of the solar panel 135, and FIG. 16 is an enlarged oblique view of the area around the guides for the solar panel 135.

To install the solar panel 135 to the base plate bridge ring 126, the solar panel 135 is first attached to the base plate 125 so that the first guide post 125*a* of the base plate 125 that functions as a provisional guide is between the first guide tabs 135*a*-1 and second guide tabs 135*a*-2 of the solar panel 135 at the second position R2. Next, the end of the fastening tab 135*a*-3 of the solar panel 135 that functions as the part engaging the panel hook 126*a* is inserted below the distal end 126*a*-1 of the panel hook 126*a* of the base plate bridge ring 126.

A specific gap is designed between the first guide tabs 135*a*-1 and second guide tabs 135*a*-2 and the first guide post 125*a*. Therefore, the solar panel 135 is provisionally positioned with a certain amount of freedom at the second position R2 by the first guide post 125*a* used as a provisional guide. Rotation of the first guide tabs 135*a*-1 and second guide tabs 135*a*-2 in the circumferential direction is also limited by the second guide post 125*b* of the base plate 125. The panel hook 126*a* also prevents the solar panel 135 from moving up.

Figure 16:
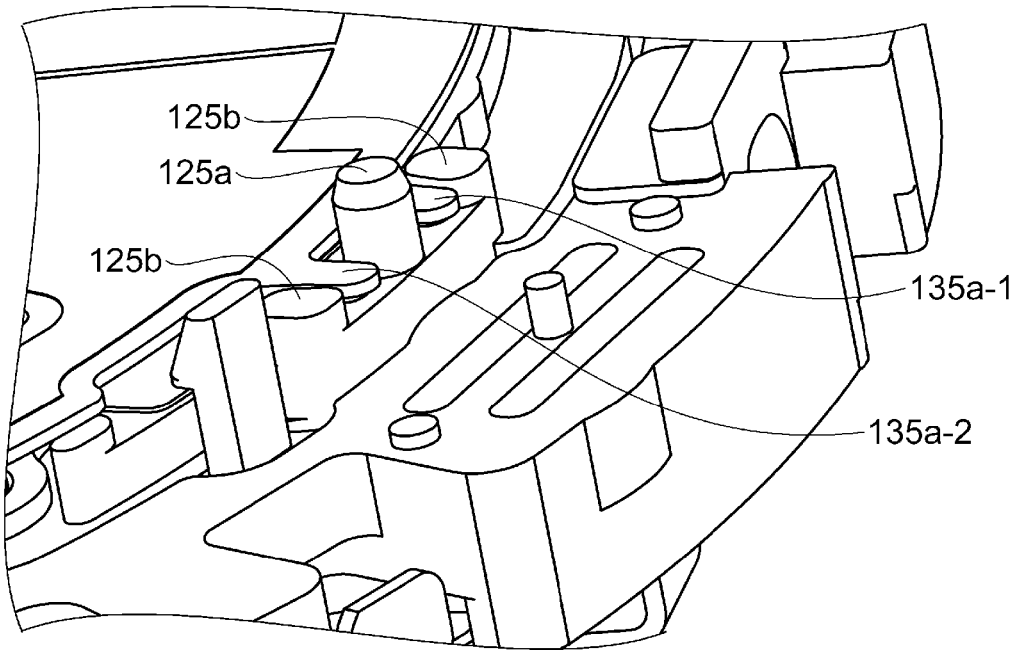
FIG. 16 is an enlarged oblique view showing the area around the guide parts of the base plate bridge ring and the guide tables of the solar panel.

Next, as shown in FIG. 14 and FIG. 16, the solar panel 135 is attached to the base plate 125 so that the first guide post 125*a* of the base plate 125 functioning as a guide member is held between the first guide tabs 135*a*-1 and second guide tabs 135*a*-2 of the solar panel 135 at the first position R1. A small gap can also be provided between the first guide tabs 135*a*-1 and second guide tabs 135*a*-2 and the first guide post 125*a*, but this gap is designed to be smaller than the gap between the first guide post 125*a* used as a provisional guide and the first guide tabs 135*a*-1 and second guide tabs 135*a*-2 at the second position R2. The solar panel 135 can therefore be reliably set to the installation position at the first position R1 by the first guide post 125*a* used as a guide member. However, as described above, because the first guide tabs 135*a*-1 and second guide tabs 135*a*-2 are provisionally positioned with a certain amount of play at the second position R2, the solar panel 135 can be easily installed at the first position R1. The first guide tabs 135*a*-1 and second guide tabs 135*a*-2 are also prevented from rotating circumferentially by the second guide post 125*b* of the base plate 125.

The solar panel 135 is likewise attached to the base plate 125 at the third position R3 so that the first guide post 125*a* of the base plate 125 functioning as a guide member is between the first guide tabs 135*a*-1 and second guide tabs 135*a*-2 of the solar panel 135. A small gap can also be provided between the first guide tabs 135*a*-1 and second guide tabs 135*a*-2 and the first guide post 125*a*, but this gap is designed to be smaller than the gap between the first guide post 125*a* used as a provisional guide and the first guide tabs 135*a*-1 and second guide tabs 135*a*-2 at the second position R2. The solar panel 135 can therefore be reliably set to the installation position at the third position R3 by the first guide post 125*a* used as a guide member. However, as described above, because the first guide tabs 135*a*-1 and second guide tabs 135*a*-2 are provisionally positioned with a certain amount of play at the second position R2, the solar panel 135 can be easily installed at the third position R3. The first guide tabs 135*a*-1 and second guide tabs 135*a*-2 are also prevented from rotating circumferentially by the second guide post 125*b* of the base plate 125.

Finally, at the fourth position R4, the solar panel 135 is attached to the base plate 125 so that the first guide post 125*a* of the base plate 125 functioning as a guide member is held between the first guide tabs 135*a*-1 and second guide tabs 135*a*-2 of the solar panel 135. The distal end of the fastening tab 135*a*-3 of the solar panel 135 also contacts the distal end 126*a*-1 of the panel hook 126*a* of the base plate bridge ring 126. As shown in FIG. 15, because a slope 126*a*-2 is formed on the distal end 126*a*-1 of the panel hook 126*a*, and the panel hook 126*a* is flexible, the fastening tab 135*a*-3 can be easily pushed down. The slope 126*a*-2 is designed so that the angle to the surface of the solar panel 135 is obtuse. The end of the fastening tab 135*a*-3 therefore moves down sliding against the slope 126*a*-2 of the distal end 126*a*-1 of the panel hook 126*a*, and when it stops sliding against the slope 126*a*-2, the fastening tab 135*a*-3 is inserted below the distal end 126*a*-1 of the panel hook 126*a* as shown in FIG. 15.

As at the second position R2, a gap larger than the gap at the first position R1 and third position R3 is designed between the first guide tabs 135*a*-1 and second guide tabs 135*a*-2 and the first guide post 125*a*. The solar panel 135 is thus provisionally positioned with a certain amount of play at the fourth position R4 by the first guide post 125*a* functioning as a provisional guide. Because the solar panel 135 is thus positioned at the fourth position R4 with a certain amount of play, inserting the fastening tab 135*a*-3 below the distal end 126*a*-1 of the panel hook 126*a* is simple.

The solar panel 135 is also secured by the panel hooks 126*a*, and is positioned vertically. This completes positioning and securing the solar panel 135.

When installing the solar panel 135 to the base plate bridge ring 126 in this example, the solar panel 135 is first installed to the second position R2, then the first position R1 and third position R3, and finally to the fourth position R4, but installation is not limited to this order. For example, the solar panel 135 may be first positioned substantially precisely in the circumferential direction, and then the entire solar panel 135 may be pressed down at once from above.

D: Positioning the Dial

Figure 17:
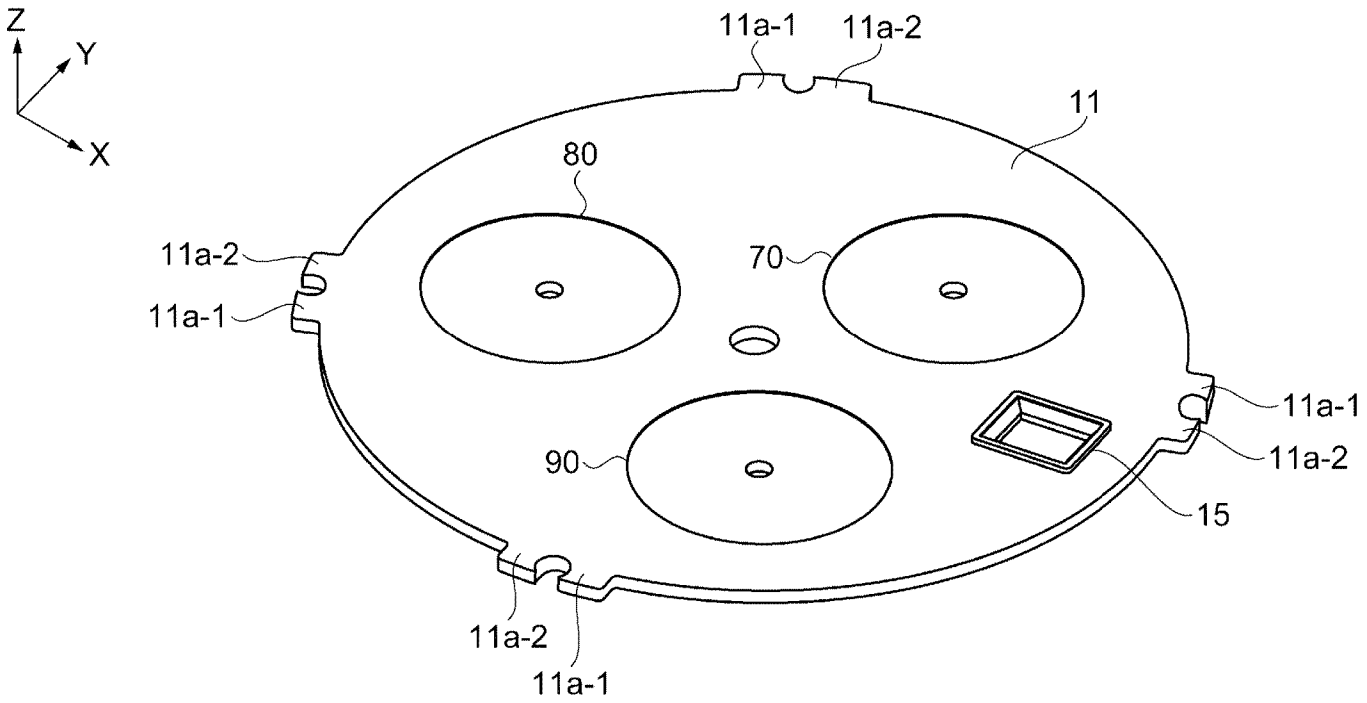
FIG. 17 is an oblique view of the dial.

The configuration of the dial 11 in this embodiment of the invention is described next with reference to FIG. 17. FIG. 17 is an oblique view of the dial 11.

The dial 11 is a round disc made of metal or plastic, for example, and as shown in FIG. 17 has a hole through which the arbor of the hands 21, 22, 23 passes in the center, and separated from the center of the dial 11 has a round first subdial 70 at 2:00, a second subdial 80 at 10:00, a third subdial 90 at 6:00, and a rectangular calendar window 15 at 4:00. While not shown in the figure, markers, numbers, letters, or other indices for indicating the time and other information are also provided around the edge of the dial 11 and in the first subdial 70 to third subdial 90.

First guide tabs 11*a*-1 and second guide tabs 11*a*-2 are disposed to the dial 11 near the 3:00 position, 6:00 position, and 9:00 position. The positions of the first guide tabs 11*a*-1 and second guide tabs 11*a*-2 on the dial 11 corresponding to the positions of the first guide tabs 135*a*-1 and second guide tabs 135*a*-2 of the solar panel 135. More specifically, the first guide tabs 11*a*-1 and second guide tabs 11*a*-2 of the dial 11 can be positioned with the first guide posts 125*a* of the base plate therebetween.

Figure 18:
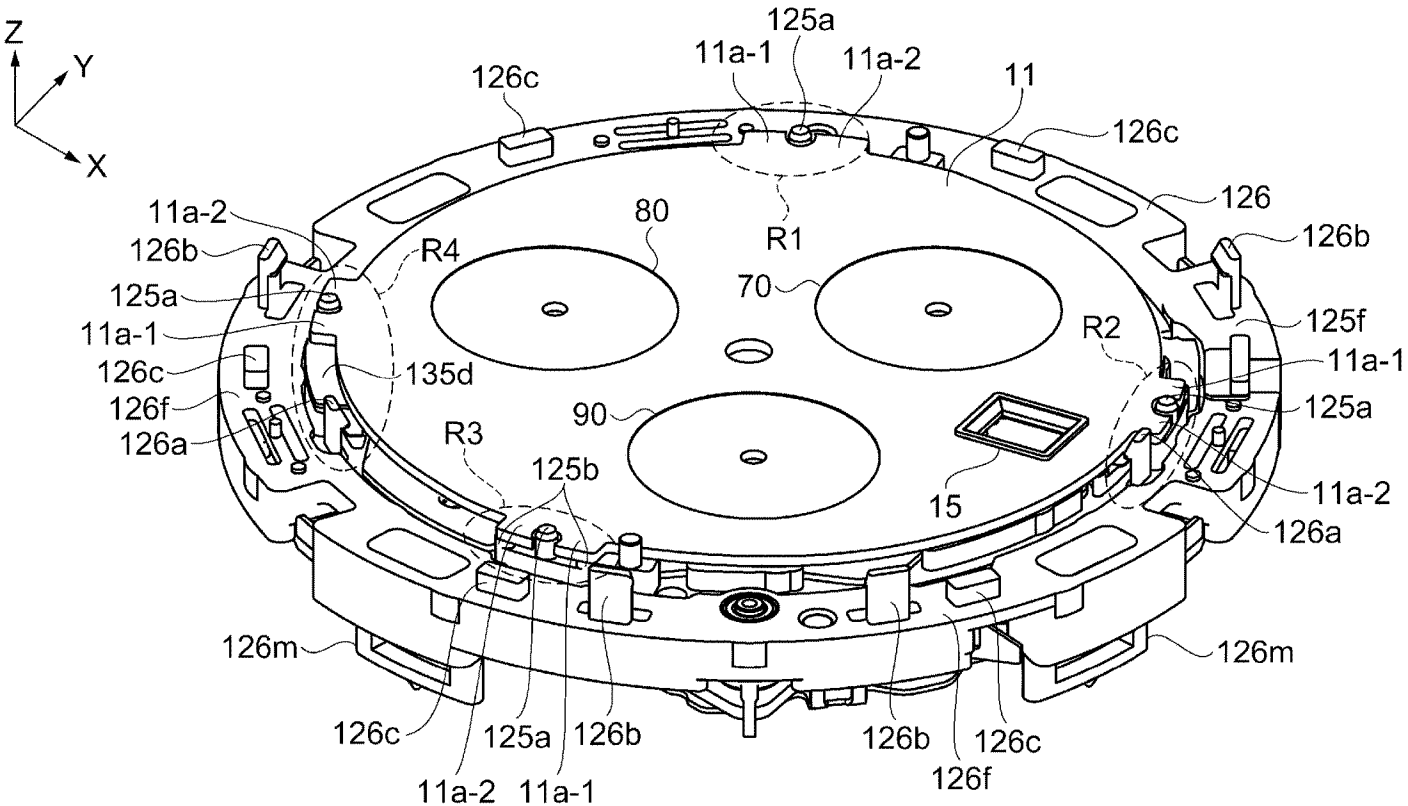
FIG. 18 is an oblique view showing the base plate bridge ring attached to the base plate, the solar panel attached to base plate bridge ring, and the dial then installed over the solar panel.
Figure 19:
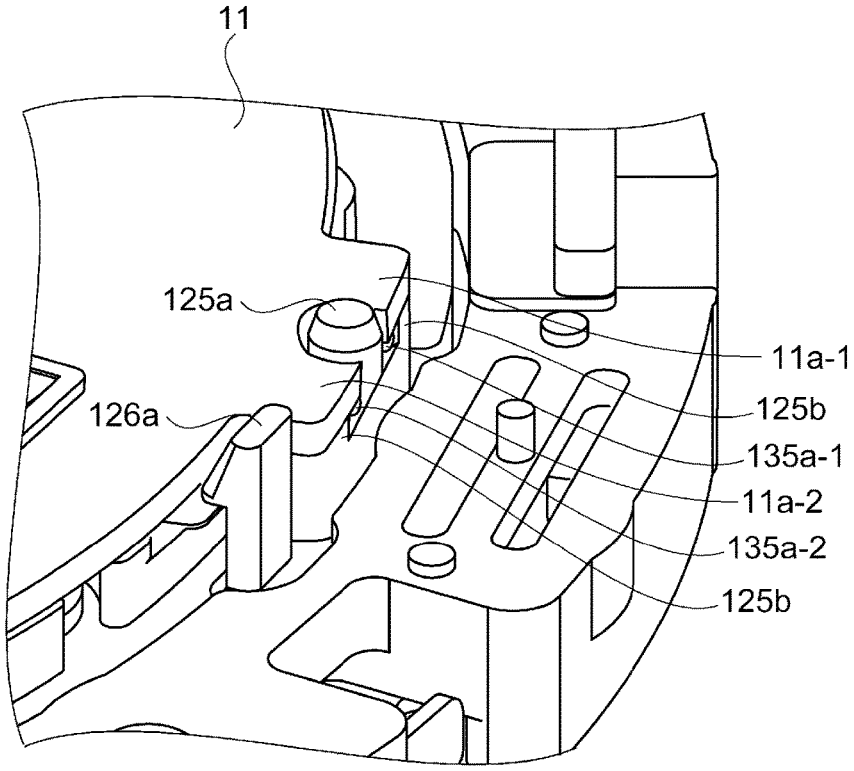
FIG. 19 is an enlarged oblique view of the area around the guide parts of the dial.

Positioning the dial 11 is described next with reference to FIG. 18 and FIG. 19. FIG. 18 shows the dial 11 installed after installing the solar panel 135 to the base plate bridge ring 126 attached to the base plate 125 shown in FIG. 14, and FIG. 19 is an enlarged oblique view of the area around the dial 11 guides.

Referring to FIG. 18, when the dial 11 is installed after installing the solar panel 135 to the base plate bridge ring 126 attached to the base plate 125, the first guide posts 125*a* of the base plate 125 are positioned and held between the first guide tabs 11*a*-1 and second guide tabs 11*a*-2 at the first position R1 to the fourth position R4.

E: Installing the Antenna

Installing the antenna is described next. In the figures referenced below, the antenna 110 is installed before the dial 11 is installed, that is, after installation of the solar panel 135 to the base plate 125 and base plate bridge ring 126 is completed as shown in FIG. 14.

Figure 20:
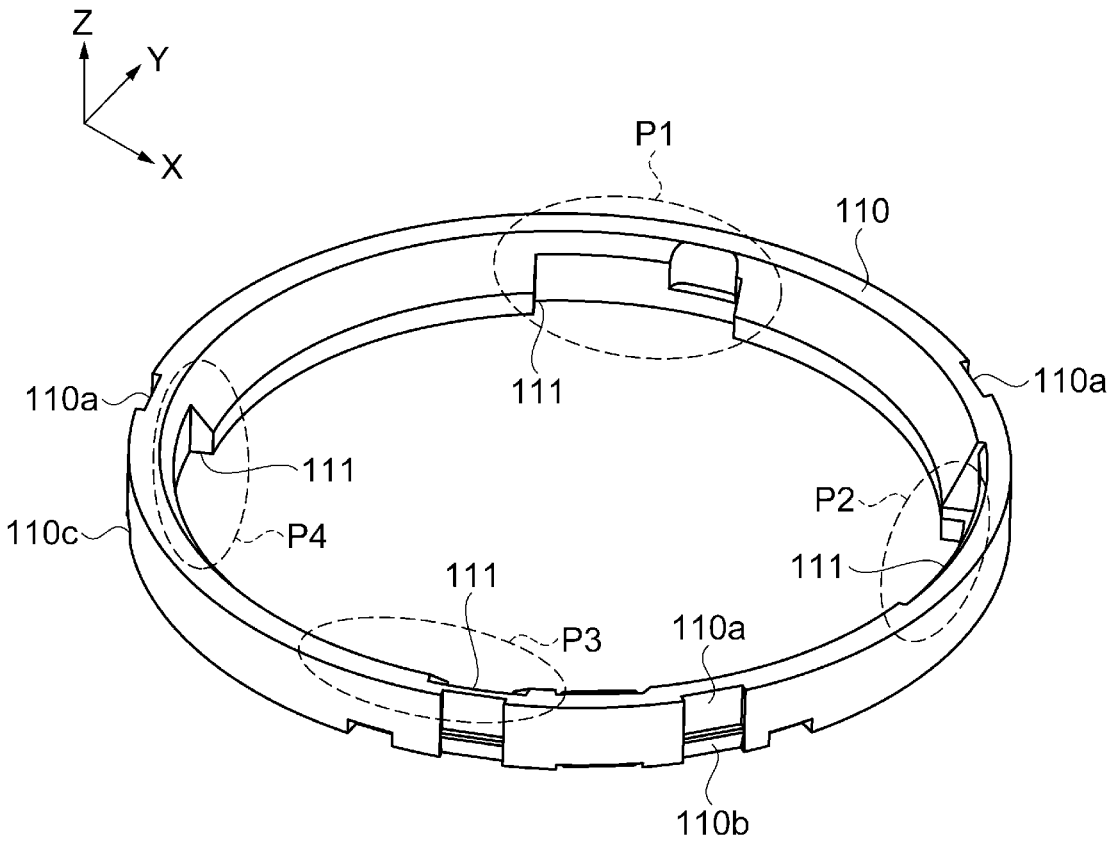
FIG. 20 is an oblique view of the antenna.
Figure 21:
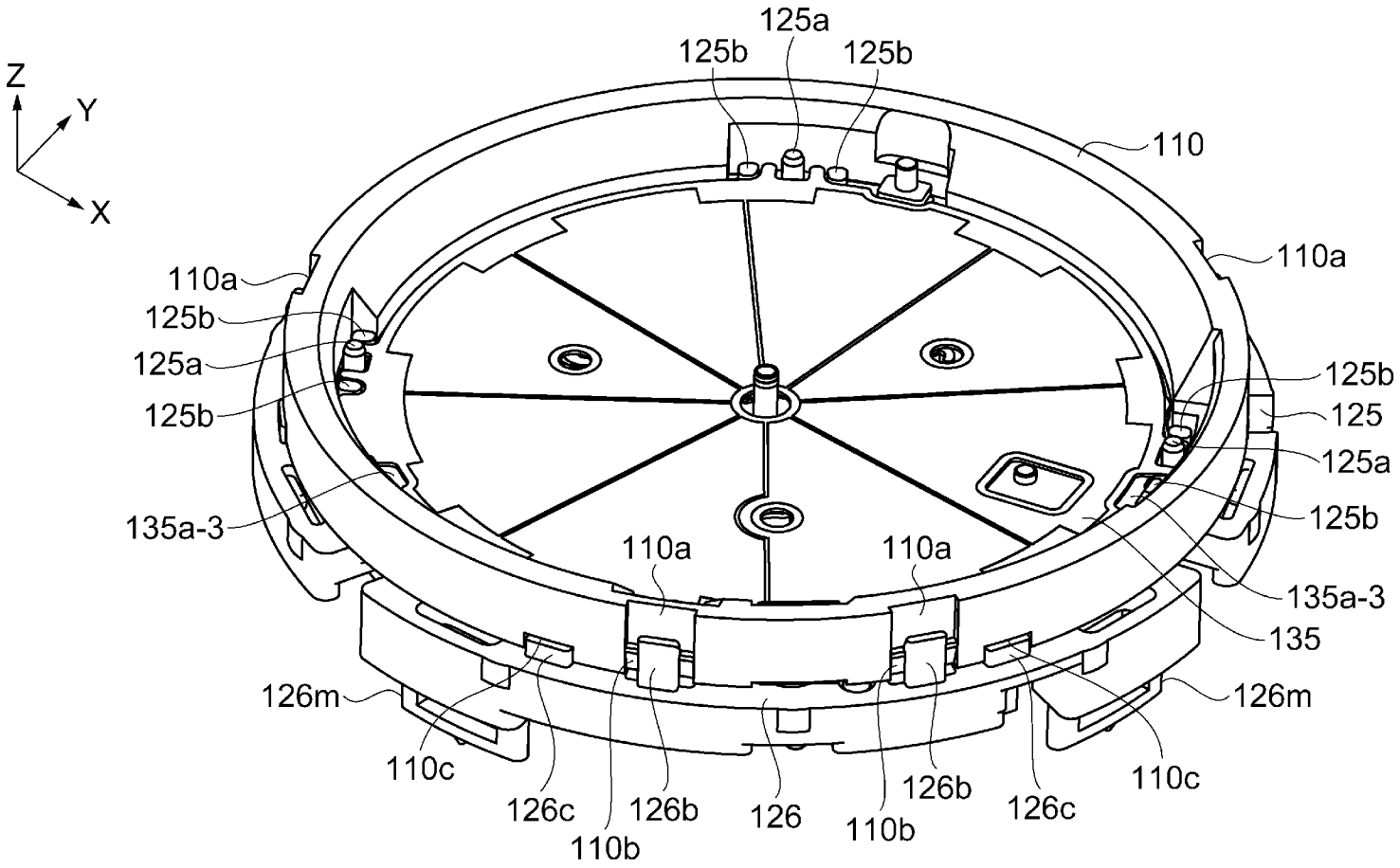
FIG. 21 is an oblique view showing the antenna secured by the base plate bridge ring securing the solar panel.

FIG. 20 is an oblique view of the antenna 110. As shown in f120, the antenna 110 in this embodiment of the invention is formed as a ring, and notches 111 are formed on the inside circumference of the antenna 110 at four positions, a first position P1, second position P2, third position P3, and fourth position P4. The first position P1, second position P2, third position P3, and fourth position P4 correspond to the first position R1, second position R2, third position R3, and fourth position R4 of the base plate 125 and base plate bridge ring 126 shown in FIG. 14. Therefore, when the antenna 110 is installed to the base plate 125 and base plate bridge ring 126 as shown in FIG. 21, the first guide posts 125*a*, second guide posts 125*b*, and flange 125*d* of the base plate 125, the panel hooks 126*a* of the base plate bridge ring 126, and the first guide tabs 135*a*-1, second guide tabs 135*a*-2, and fastening tabs 135*a*-3 of the solar panel 135 are housed in the notches 111.

Figure 22:
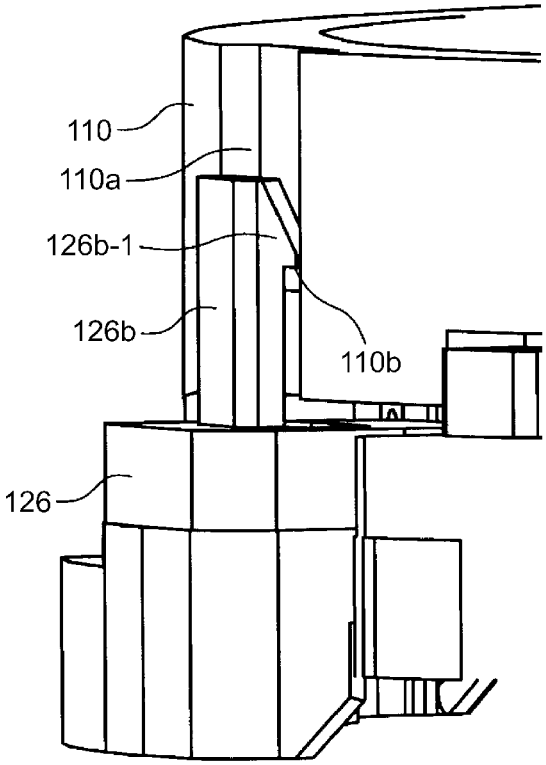
FIG. 22 is an enlarged oblique view of the area around the antenna hooks of the base plate bridge ring and the engaging parts of the antenna.

As shown in FIG. 20, notches 110*a* are formed at three locations around the outside of the antenna 110, and a flange 110*b* is disposed in each of the notches 110*a*. By attaching the antenna 110 to the base plate bridge ring 126, as shown in FIG. 21 and FIG. 22, the flanges 110*b* and the distal ends 126*b*-1 of the antenna hooks 126*b* of the base plate bridge ring 126 engage, and the antenna 110 is thereby secured and positioned vertically. The antenna hooks 126*b* of the base plate bridge ring 126 therefore function as fasteners of the antenna 110.

Plural positioning recesses 110*c* are also disposed to the bottom of the antenna 110 as shown in FIG. 20. When the antenna 110 is installed to the base plate bridge ring 126, the antenna posts 126*c* of the base plate bridge ring 126 and the positioning recesses 110*c* of the antenna 110 engage, and the antenna 110 is positioned circumferentially.

Because the antenna 110 is thus positioned by the base plate bridge ring 126, and the solar panel 135 is also positioned by the base plate bridge ring 126, the solar panel 135 is reliably positioned relative to the antenna 110 with no deviation.

Furthermore, when the diameter or shape of the antenna in the electronic timepiece 10 changes, for example, it is only necessary to change the design of the antenna hooks of the base plate bridge ring 126, and the design of the electronic timepiece 10 can be changed while continuing to use the same base plate 125.

Furthermore, because the dial 11 and solar panel 135 are guided directly by the base plate, the dial and solar panel can also be used without modification.

Accommodating design changes when the outside diameter of the electronic timepiece changes Accommodating changes in design that change the outside diameter of the electronic timepiece 10 is described next.

Figure 23:
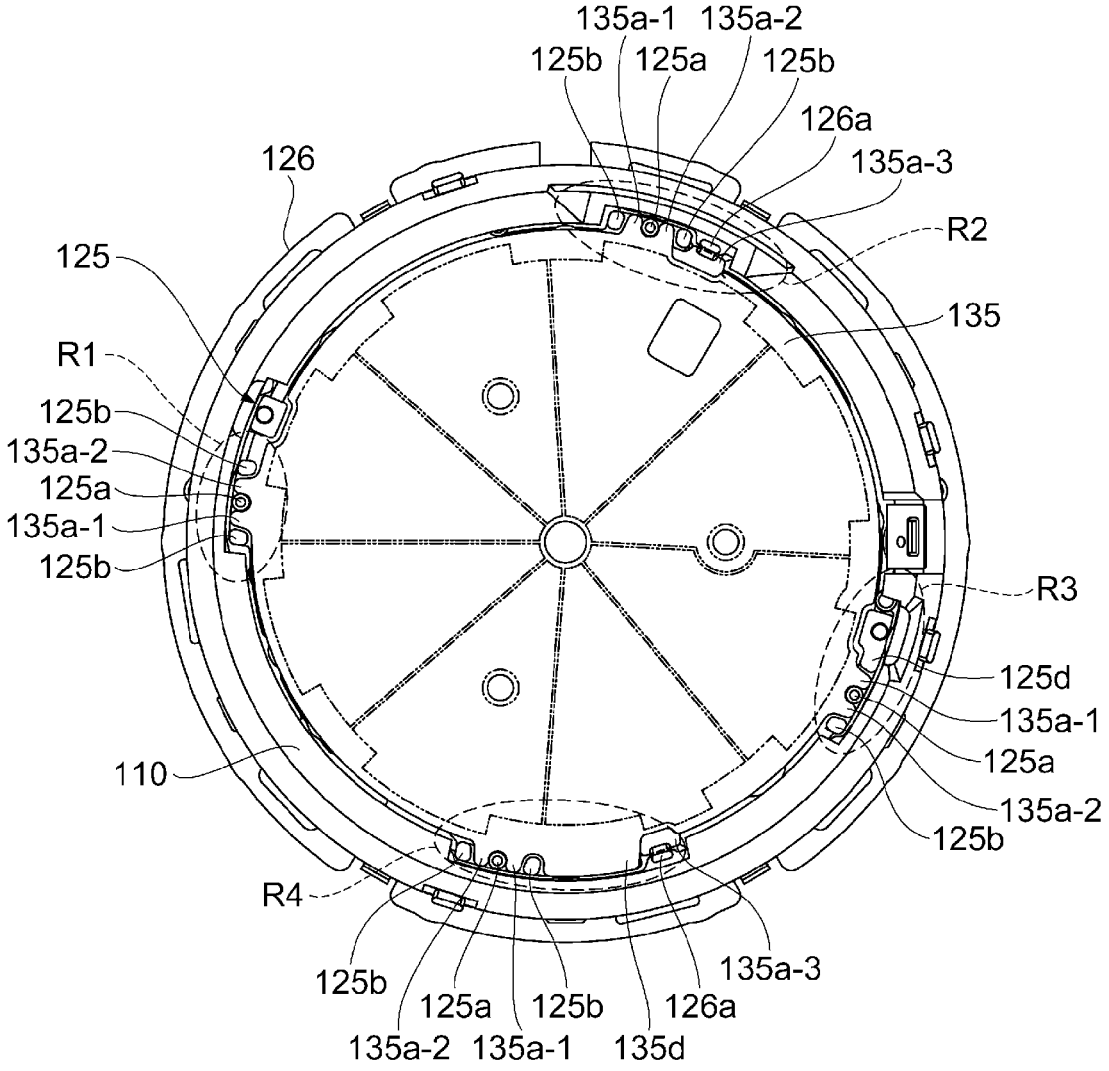
FIG. 23 is a plan view of the electronic timepiece before changing the outside diameter.

FIG. 23 is a plan view showing the antenna 110 installed to the base plate bridge ring 126 in the electronic timepiece 10 described above. More specifically, FIG. 23 illustrates the electronic timepiece 10 before changing the outside diameter.

Reducing the outside diameter of the electronic timepiece

Figure 24:
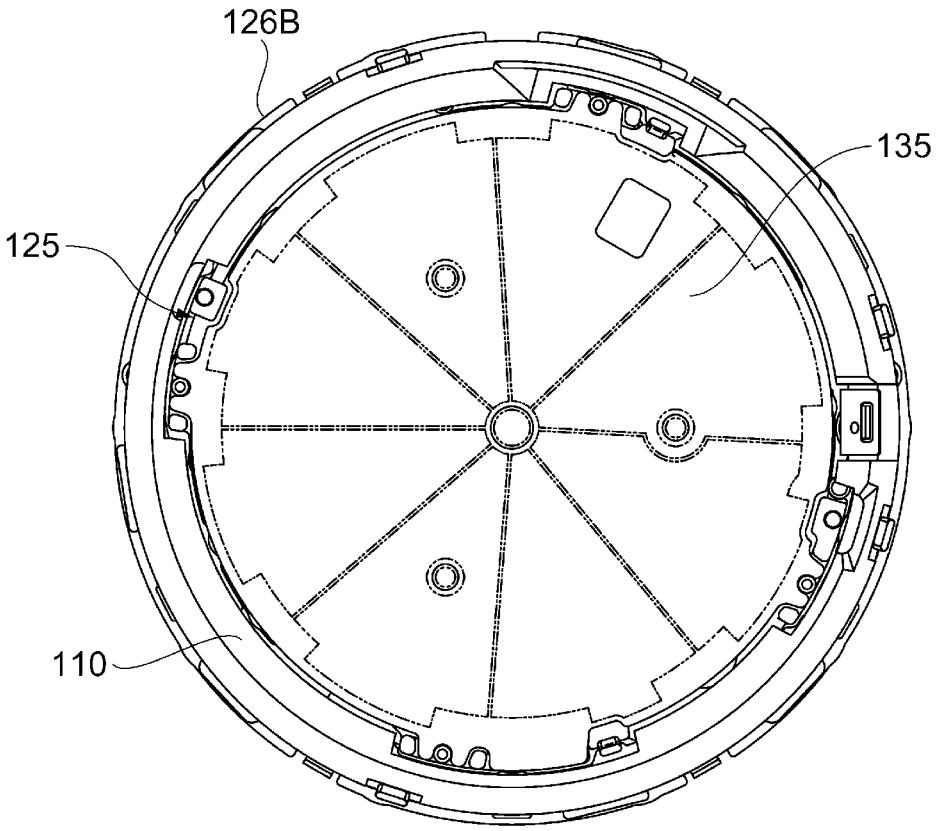
FIG. 24 is a plan view of the electronic timepiece after reducing the outside diameter.

FIG. 24 is a plan view showing the antenna 110 installed to the base plate bridge ring 126 when the design of the electronic timepiece is changed to reduce the outside diameter. As shown in FIG. 24, the base plate 125 is the same base plate 125 shown in FIG. 23 before changing the outside diameter. To reduce the outside diameter of the electronic timepiece 10, the size (diameter) of the base plate bridge ring 126B that supports the base plate 125 in the outside case 30 and is disposed between the base plate 125 and the outside case 30 (see FIG. 4) is changed. More specifically, the base plate bridge ring (second base plate bridge ring) 126B shown in FIG. 24 is changed so that the diameter of the outside surface that contacts the outside case 30 is reduced but the inside diameter that supports the base plate 125 is not changed when compared with the base plate bridge ring (first base plate bridge ring) 126 shown in FIG. 23 before changing the size.

The dial 11 and solar panel 135 are used without being changed.

As described above, a configuration using the base plate 125 and the base plate bridge ring 126, 126B of the invention provides first guide posts 125*a* and second guide posts 125*b* that guide the solar panel 135 and dial 11 on the base plate 125, and provides antenna hooks 126*b* that support the antenna 110 on the base plate bridge ring 126 that supports the base plate 125 in the outside case 30. When the electronic timepiece 10 is redesigned to have a smaller outside diameter, the design can be accommodated by using the base plate bridge ring 126B having a smaller outside diameter. As a result, the number of parts that must be changed can be minimized, and a electronic timepiece 10 with a small outside diameter can be provided at a low cost.

Increasing the outside diameter of the electronic timepiece

Figure 25:
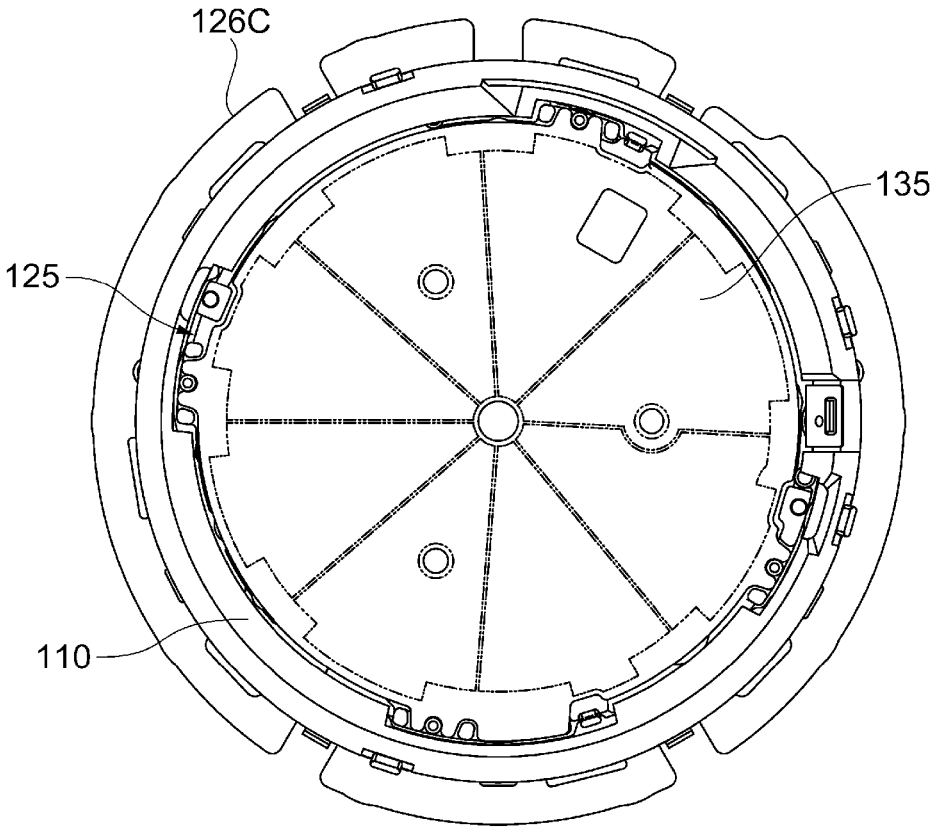
FIG. 25 is a plan view of the electronic timepiece after increasing the outside diameter.

FIG. 25 is a plan view showing the antenna 110 installed to the base plate bridge ring 126 when the design of the electronic timepiece is changed to increase the outside diameter. As shown in FIG. 25, the base plate 125 that guides and positions the solar panel 135 and dial 11 not shown by means of the first guide posts 125*a* and second guide posts 125*b* is the same base plate 125 shown in FIG. 23 before changing the outside diameter and the same base plate 125 shown in FIG. 24 when reducing the outside diameter. To increase the outside diameter of the electronic timepiece 10, only the size (diameter) of the base plate bridge ring 126C that supports the base plate 125 in the outside case 30 is changed.

More specifically, the base plate bridge ring (second base plate bridge ring) 126C shown in FIG. 25 is changed so that the diameter of the outside surface that contacts the outside case 30 is increased but the inside diameter that supports the base plate 125 is not changed when compared with the base plate bridge ring (first base plate bridge ring) 126 shown in FIG. 23 before changing the size.

The dial 11 and solar panel 135 are used without being changed.

As a result, as when reducing the outside diameter of the electronic timepiece 10, when the electronic timepiece 10 is redesigned to have a larger outside diameter, the design can be accommodated by using a base plate bridge ring 126C having a larger outside diameter without changing the base plate 125, the number of parts that must be changed can be minimized, and a electronic timepiece 10 with a different outside diameter can be easily provided.

Design changes that change the outside diameter of the electronic timepiece 10 are described above, but the invention is not so limited. Because the base plate bridge ring 126 has antenna hooks 126*b* that support the antenna 110, changing the design of the antenna can also be accommodated by changing the design of the base plate bridge ring 126 while using the same base plate 125. For example, when the outside diameter of the antenna is reduced and the position of the flange 110*b* is moved toward the center of the electronic timepiece, the positions of the antenna hooks 126*b* on the base plate bridge ring 126 can be simply changed to accommodate the changed position of the flange 110*b*.

Figure 26A:
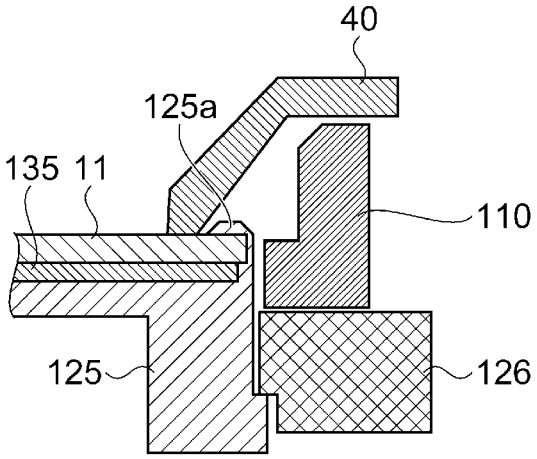
FIGS. 26A-26C are partial section views illustrating increasing the parting diameter in conjunction with changing the outside diameter of the electronic timepiece.
Figure 26B:
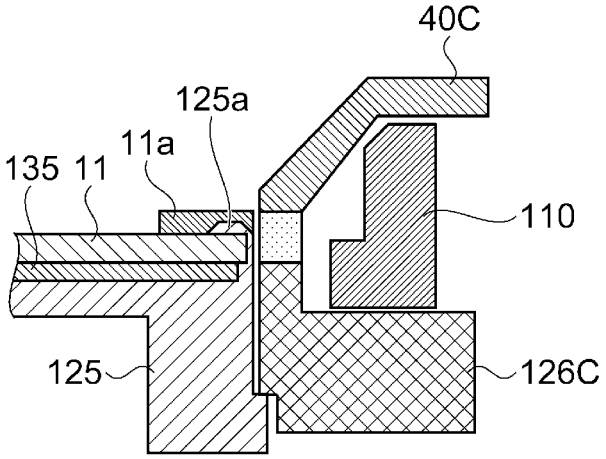
Figure 26C:
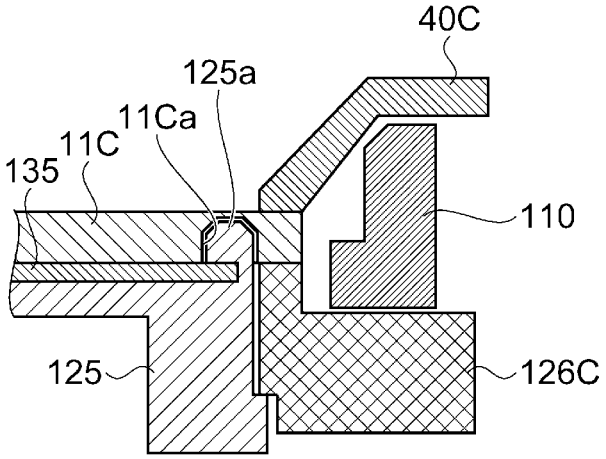

FIGS. 26A-26C are enlarged section views of the area around the first guide post 125*a* of the base plate 125 that guides the base plate 125 and dial 11, and shows examples of increasing the parting diameter in conjunction with changing the outside diameter design.

FIG. 26A is a section view of this area in the electronic timepiece 10 shown in FIG. 23 before the design change. In this example, the dial ring 40 is disposed above and overlapping in plan view the first guide posts 125*a* (and second guide posts 125*b* not shown) of the base plate 125 that guide the solar panel 135 and dial 11. As a result, the first guide posts 125*a* cannot be seen from the outside.

To increase the outside diameter in this example, the electronic timepiece may appear small and the appearance may be impaired if the parting diameter, that is, the inside diameter of the dial ring 40, is not also increased. However, if the inside diameter of the dial ring 40 increases, the first guide posts 125*a* of the base plate 125 that guide the solar panel 135 and dial 11 can be seen.

This problem can be solved as described below.

In FIG. 26B, the first guide posts 125*a* that guide the dial 11 are disposed to positions exposed from the dial ring 40C in plan view, but the markers 11*a* on the dial 11 for indicating the time are disposed to positions covering the first guide posts 125*a* in plan view. As a result, the markers 11*a* of the dial 11 prevent the first guide posts 125*a* from being seen from the outside.

FIG. 26C illustrates an example of accommodating a design change by using a dial 11C (second dial) with a larger outside diameter than the normal dial 11. The dial 11C shown in FIG. 26C has recesses 11Ca that hold the first guide posts 125*a* in an area covering the first guide posts 125*a* of the base plate 125 in plan view. While not shown in the figure, the dial 11C also has recesses that hold the second guide posts 125*b* of the base plate 125.

Thus comprised, even when the inside diameter of the dial ring 40 of the electronic timepiece 10 is increased, a common base plate 125 can be used to accommodate the design change at low cost. Note that the dial 11C can also be guided (positioned) to the base plate 125 in this configuration by mating the first guide posts 125*a* of the base plate 125 with the recesses 11Ca of the dial 11C.

The invention being thus described, it will be obvious that it may be varied in many ways. Such variations are not to be regarded as a departure from the spirit and scope of the invention, and all such modifications as would be obvious to one skilled in the art are included within the scope of the following claims.

For example, when the outside diameter of the electronic timepiece 10 is changed in the foregoing examples, the same dial 11 and solar panel 135 are used, or when the outside diameter of the electronic timepiece 10 is increased, a dial 11C that is larger than the existing dial 11 may be used, but the invention is not so limited. A dial 11 or solar panel 135 that changes the shape or size of parts other than the shapes that are guided by the base plate may also be used. This enables creating electronic timepieces with many different designs while using the same base plate.

The foregoing embodiments describe configurations having guide parts for the dial 11 and solar panel 135 on the base plate 125, but these guide parts may also be disposed to the base plate bridge ring. As a result, the same base plate can be used to easily accommodate changing the design of the dial 11 by changing the outside diameter of the electronic timepiece 10.

The entire disclosure of Japanese Patent Application No. 2014-246578, filed Dec. 5, 2014 is expressly incorporated by reference herein.

What is claimed is:

1. An electronic timepiece comprising:

a base plate;

an outside case member engaged with a bezel; and a base plate bridge ring that supports a ring-shaped antenna at a top surface of the base plate bridge ring, contacts the outside case member, and supports the base plate;

the base plate configured to not contact the outside case member.

2. The electronic timepiece described in claim 1, further comprising:

a solar panel;

the base plate functioning to guide the solar panel.

3. The electronic timepiece described in claim 1, further comprising:

a dial;

the base plate having a dial guide post that is disposed on an outer diameter of the dial and guides the dial.

4. The electronic timepiece described in claim 3, wherein:

the dial has a recess in which the dial guide post fits in an area overlapping the dial guide post of the base plate in plan view.

5. The electronic timepiece described in claim 3, wherein:

a marker is disposed to the dial in an area overlapping the dial guide post of the base plate in plan view.

6. The electronic timepiece described in claim 2, wherein the base plate includes a guide post that is disposed on an outer diameter of the solar panel and guides the solar panel.

7. The electronic timepiece described in claim 1, wherein the base plate bridge ring includes a protrusion that engages an outside circumference of the base plate to support the base plate.

8. The electronic timepiece described in claim 1, wherein the outside case member includes a radially inwardly protruding member that engages a top surface of the base plate bridge ring to secure the base plate bridge ring.

* * * * *